US010525748B2

(12) United States Patent
Takahashi

(10) Patent No.: US 10,525,748 B2
(45) Date of Patent: Jan. 7, 2020

(54) UNIT ATTACHING STRUCTURE AND PRINTING DEVICE

(71) Applicant: BROTHER KOGYO KABUSHIKI KAISHA, Nagoya, Aichi (JP)

(72) Inventor: Toshihiro Takahashi, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 16/043,600

(22) Filed: Jul. 24, 2018

(65) Prior Publication Data

US 2019/0030929 A1 Jan. 31, 2019

(30) Foreign Application Priority Data

Jul. 31, 2017 (JP) ..... 2017-148383

(51) Int. Cl.
*B41J 15/04* (2006.01)
*B41J 29/02* (2006.01)
*B41J 3/407* (2006.01)

(52) U.S. Cl.
CPC ..... *B41J 15/044* (2013.01); *B41J 3/4075* (2013.01); *B41J 29/02* (2013.01)

(58) Field of Classification Search
CPC ..... B41J 15/044; B41J 3/4075; B41J 29/02
See application file for complete search history.

(56) References Cited

U.S. PATENT DOCUMENTS 10,150,307 B2 * 12/2018 Sakano ..... B41J 2/325
2018/0079228 A1 3/2018 Sakano

FOREIGN PATENT DOCUMENTS

JP 2016-175193 A 10/2016

* cited by examiner

*Primary Examiner* — Huan H Tran
(74) *Attorney, Agent, or Firm* — Scully, Scott, Murphy & Presser, P.C.

(57) ABSTRACT

A unit attaching structure configured to attach a unit to an attachment part of a printing device. The attachment part has a bottom wall and a side wall intersecting with the bottom wall. When the unit starts contacting a pressing plate, the unit contacts a contacting part which is a part of a particular end part of the pressing plate on a side opposite to the bottom wall and shifted in the third direction with respect to a position of center of load of gravity of the urging member to the pressing plate. The unit moves with contacting the pressing plate and is attached to the attachment part after contacting the contacting part. A contacting range, in the third direction, of the unit and the contacting part is smaller than a contacting range, in the third direction, of the unit attached to the attachment part and the pressing part.

19 Claims, 13 Drawing Sheets

5
32A
80
36
512
31
32
50
30
20A
20B
H2
H1
1
49A
201
202
43
F
33
65B
28B
53
54
52
51
65A
28A
H4
H3

UNIT ATTACHING STRUCTURE AND PRINTING DEVICE

CROSS-REFERENCE TO RELATED APPLICATIONS

This application claims priority under 35 U.S.C. § 119 from Japanese Patent Application No. 2017-148383 filed on Jul. 31, 2017. The entire subject matter of the application is incorporated herein by reference.

BACKGROUND

Technical Field

The present disclosures relate to a unit attaching structure and a printing device employing the unit attaching structure.

Related Art

Conventionally, a printing device configured to perform a printing operation using a unit such as a tape cassette, which is attached to the printing device when in use. As an example of such a conventional printing device, a tape printer is widely known. The tape printer typically includes a cartridge attaching part and a sensor unit. To the cartridge attaching part, a tape cartridge is attached. Generally, on the tape cartridge, a substrate is provide. The sensor unit is typically provided with a sensor holder and a unit urging part. The sensor holder has a sensor cover on which a gentle slope is formed. The unit urging part is configured to urge the sensor holder so as to press-contact the substrate of the tape cartridge attached to the cartridge attaching part. When the tape cartridge is attached to the cartridge attaching part, an end part of the tape cartridge contacts the gentle slope of the sensor cover. Then, the tape cartridge is moved further with keep contacting the sensor holder, and is finally attached to the cartridge attaching part.

SUMMARY

According to the conventional printing device described above, when the tape cartridge is attached to the cartridge attaching part, the end part of the tape cartridge contacts an entire area of the gentle slope of the sensor cover, a workload of a user when the tape cartridge is attached to the cartridge attaching part increases.

According to aspects of the present disclosures, there is provided a unit attaching structure, which has an attachment part having a bottom wall and a side wall intersecting with the bottom wall, a unit configured to be detachable and attachable with respect to the attachment part along a first direction perpendicular to the bottom wall, a guiding member extending in the first direction, the guiding member being configured to engage with the unit to guide the unit to the attachment part when the unit is to be attached to the attachment part, and a pressing part provided to the side wall and configured to press the unit attached to the attachment part. The pressing part includes a pressing plate having a rectangular shape viewed from a direction perpendicular to the side wall, the pressing plate being movable between a first position and a second position, the pressing plate being configured to protrude from the side wall when located at the first position, the pressing plate being configured to protrude from the side wall by a less amount when located at the second position than when located at the first position, the pressing plate being configured to contact the unit when the unit is attached to the attachment part, and an urging member configured to urge the pressing plate from the second position toward the first position. The pressing plate has a pressing surface directed to a second direction from the second position to the first position, a plurality of first conductive electrodes being arranged on the pressing surface in a third direction perpendicular to both the first direction and the second direction. When the unit starts contacting the pressing plate, the unit is configured to contact a contacting part, the contacting part being a part of a particular end part of the pressing plate on a side opposite to the bottom wall and shifted in the third direction with respect to a position of center of load of gravity by urging of the urging member to the pressing plate. The unit is configured to move with contacting the pressing surface and to be attached to the attachment part after contacting the contacting part. A contacting range, in the third direction, of the unit and the contacting part is smaller than a contacting range, in the third direction, of the unit attached to the attachment part and the pressing plate.

According to aspects of the present disclosures, there is further provided a printing device which employs the unit attaching structure as described above. The unit contains a printing medium. The printing device further includes a printing part configured to perform printing on the printing medium, and a cutting mechanism configured to cut out the printing medium on which printing is performed by the printing device. The pressing plate is arranged at a position spaced from the bottom wall.

BRIEF DESCRIPTION OF THE ACCOMPANYING DRAWINGS

Figures 12A, 12B, 12C, 12D:
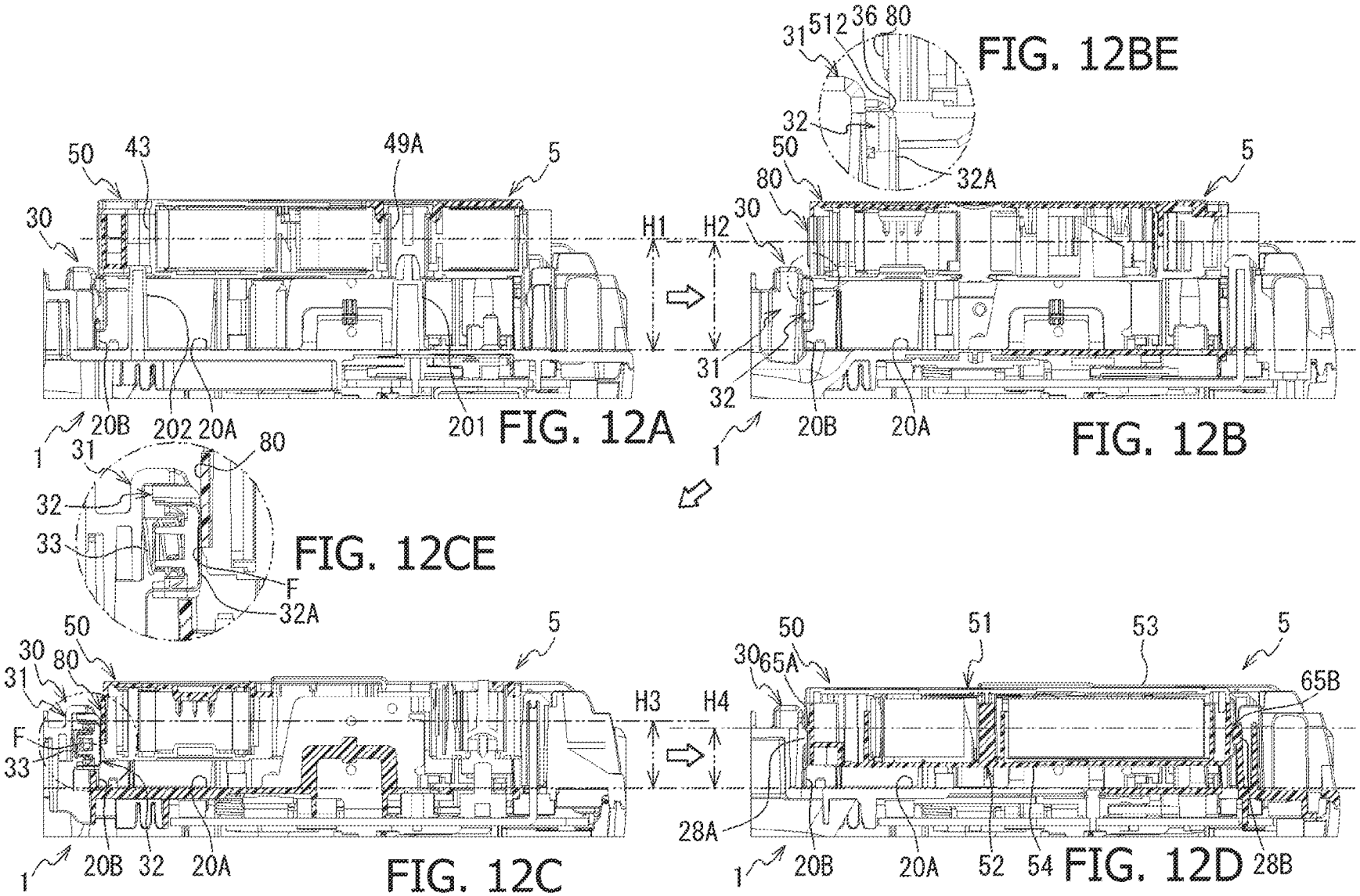

FIGS. 12A, 12B, 12BE, 12C, 12CE and 12D are cross-sectional views of the printing device and the tape cassette illustrating operations of attaching the tape cassette to the printing device.

FIG. 12BE is an enlarged view of a circled portion of FIG. 12B.

FIG. 12CE is an enlarged view of a circled portion of FIG. 12C.

Figure 13:
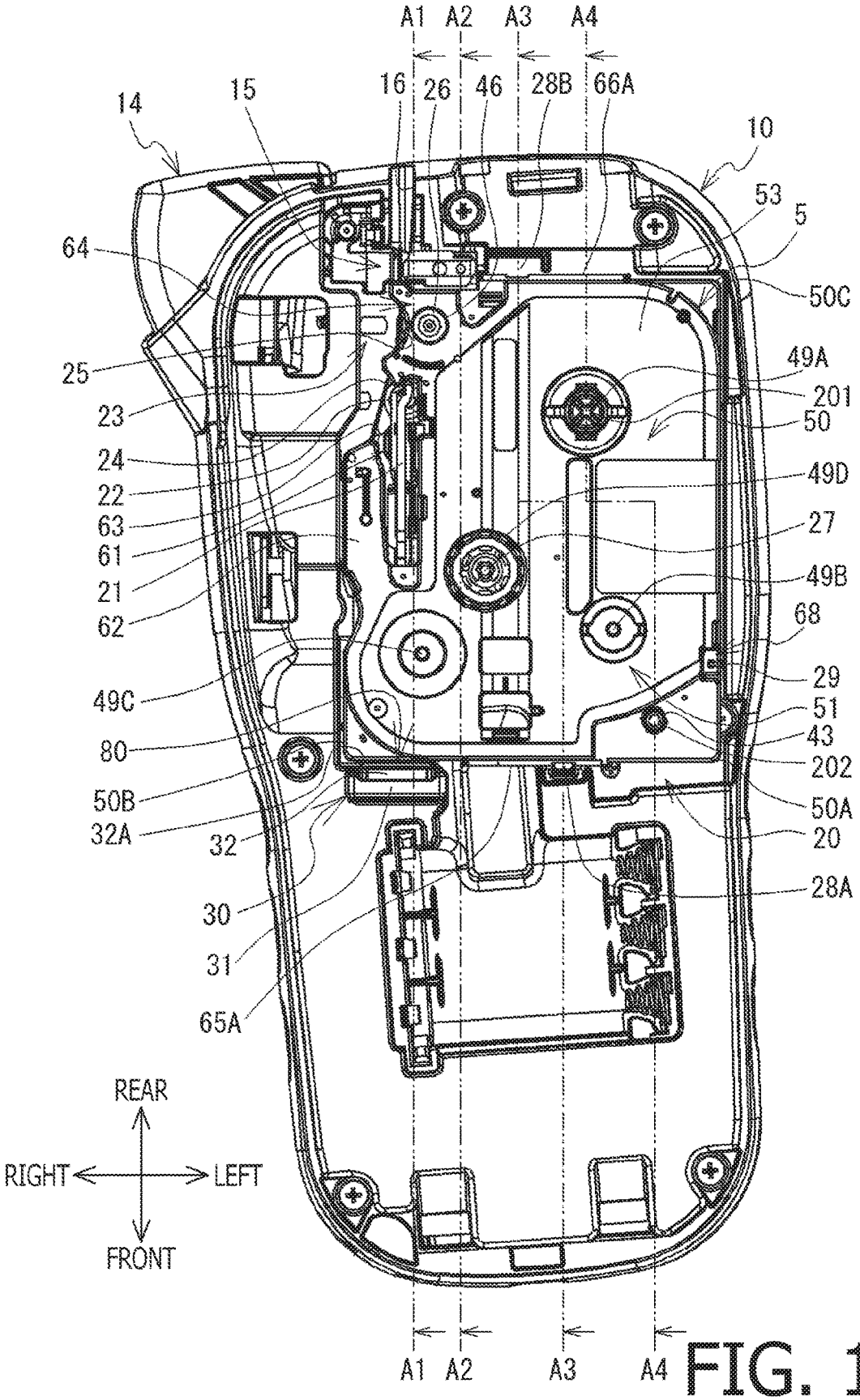

FIG. 13 is a bottom plan view of the casing when the tape cassette is attached to the attaching part.

Figure 14:
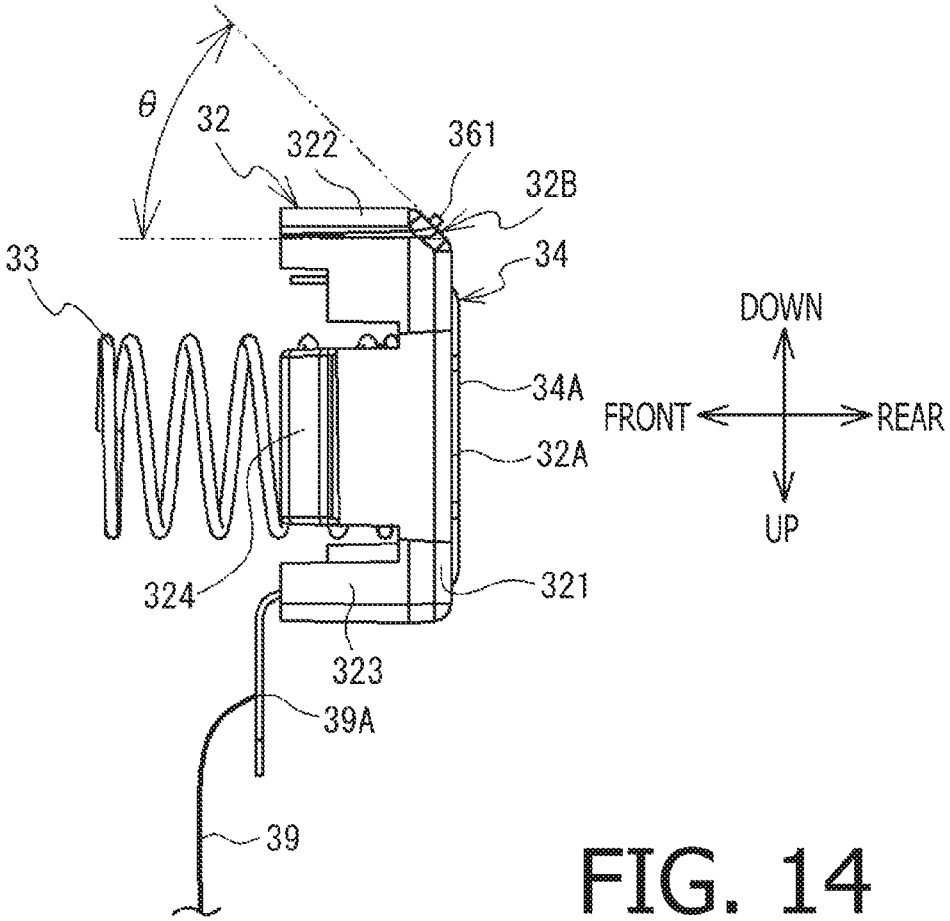

FIG. 14 is a left side view of the pressing part provided with a contacting part according to a modification of the illustrative embodiment.

DESCRIPTION OF THE ILLUSTRATIVE EMBODIMENTS

Hereinafter, an illustrative embodiment of the present disclosures will be described referring to the accompanying drawings. It is noted that the drawings referred to hereinafter are for illustrating technical characteristics which can be employed according to the aspects of the present disclosures. Configurations of respective devices shown in the drawings are only examples and are not intended to limit the aspects of the present disclosures.

Firstly, an overall configuration of a printer 1 according to an illustrative embodiment of the present disclosures will be described, referring to FIGS. 1-3. In the following description, an upper left side, a lower right side, a lower left side, an upper right side, an upper side and a lower side of FIG. 1 will be defined as a left side, a right side, a front side, a rear side, an upper side and a lower side of the printer 1, respectively. According to the illustrative embodiment, the printer 1 is configured to use any one of various types of tape cassettes (e.g., a receptor type cassette, a thermal type cassette, a laminate type cassette, a tube type cassette). In the following description, an elongated recoding mediums accommodated in respective tape cassettes 5 (see FIG. 8) (e.g., a one-sided-adhesive tape, a heat-sensitive tape, a both-sided adhesive tape, a film tape 7, a tube tape) will be collectively referred to as a "tape." The printer 1 is configured to perform a printing operation to print letters, characters and images on the tape.

Figure 1:
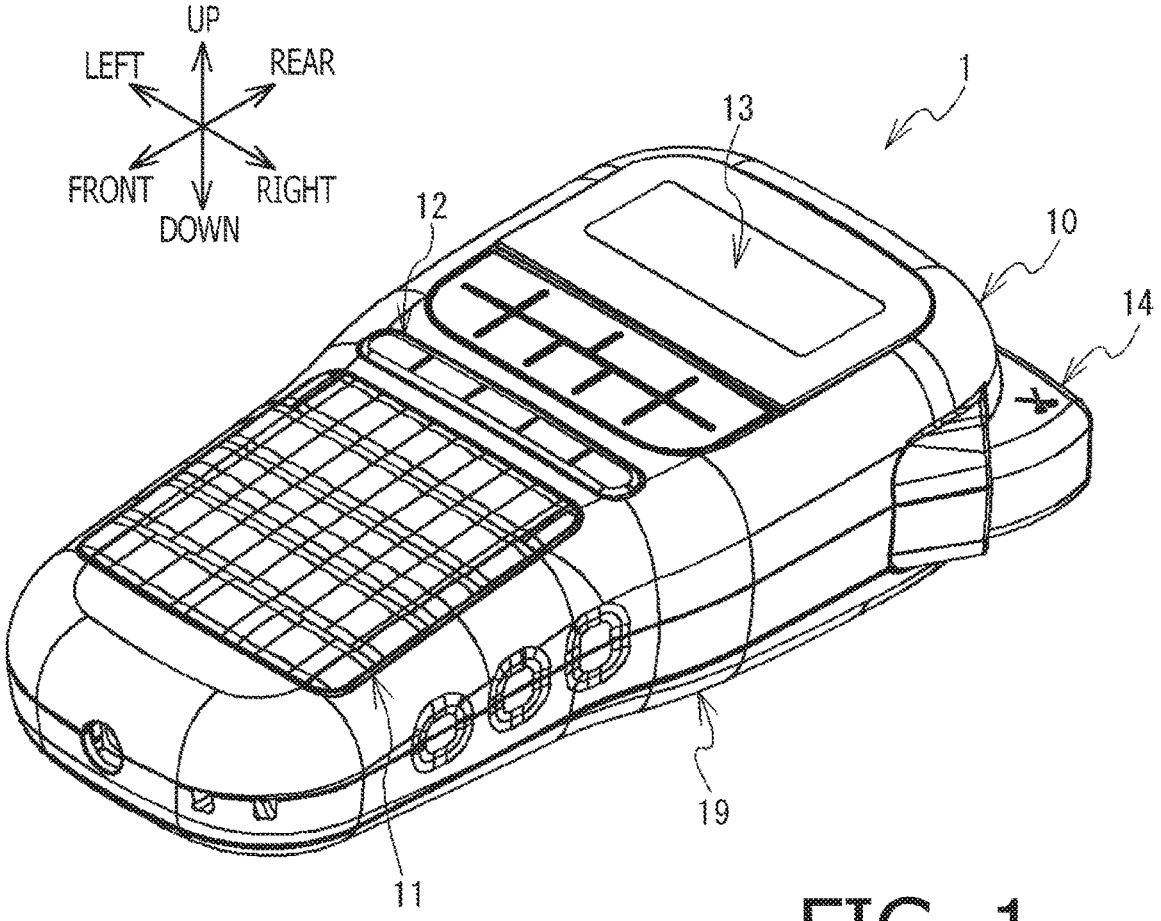
FIG. 1 is a perspective view, viewed from an upper right front side, of a printing device according to an illustrative embodiment of the present disclosures.

The printer 1 has a substantially rectangular parallelepiped shape as shown in FIG. 1. The printer 1 has a casing 10 and a cover 19. On a front side of an upper surface of the casing 10, a keyboard 11 are provided. The keyboard 11 is used for inputting various characters/letters. On a rear side with respect to the keyboard 11, a function key group 12 is provided. The function key group 12 includes a power button and a print start button. Through the function key group 12, various instructions can be input to the printer 1. On the rear side with respect to the keyboard group 12, a liquid crystal display 13 is arranged. The liquid crystal display 13 displays the characters/letters input through the keyboard 11. The cover 19 is openably/closably attached to a lower side of the casing 10.

Figure 2B:
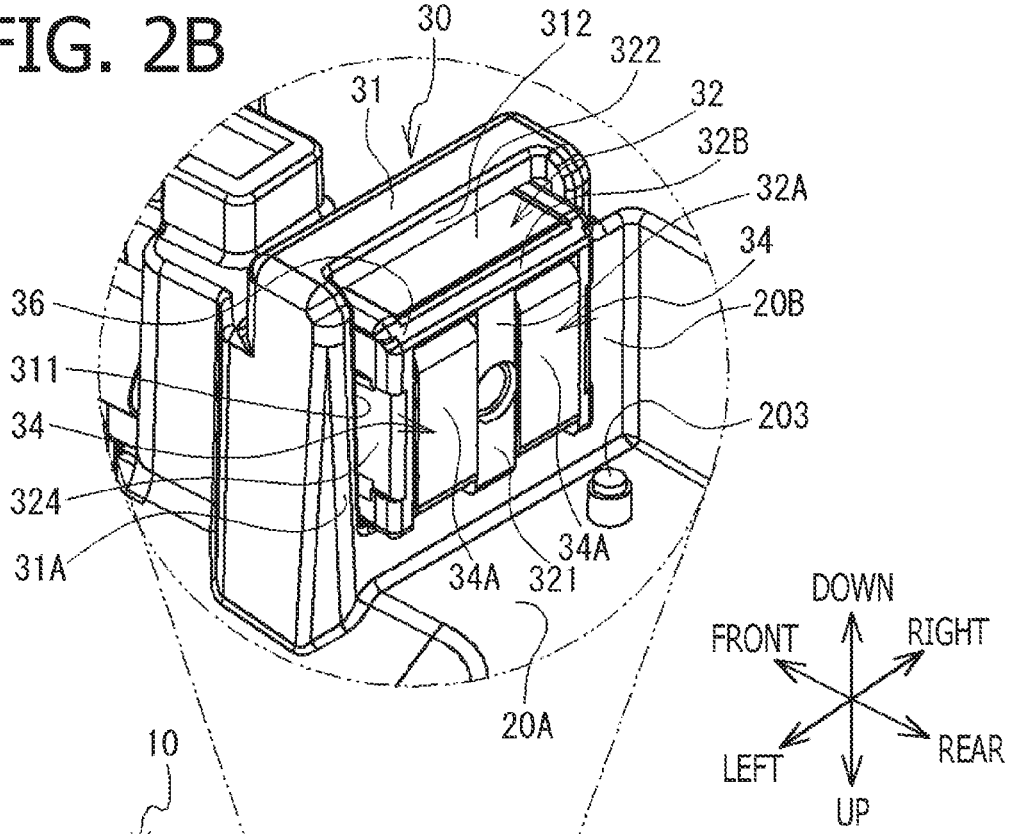
FIG. 2B is an enlarge perspective view showing a circled portion in FIG. 2A.
Figure 2A:
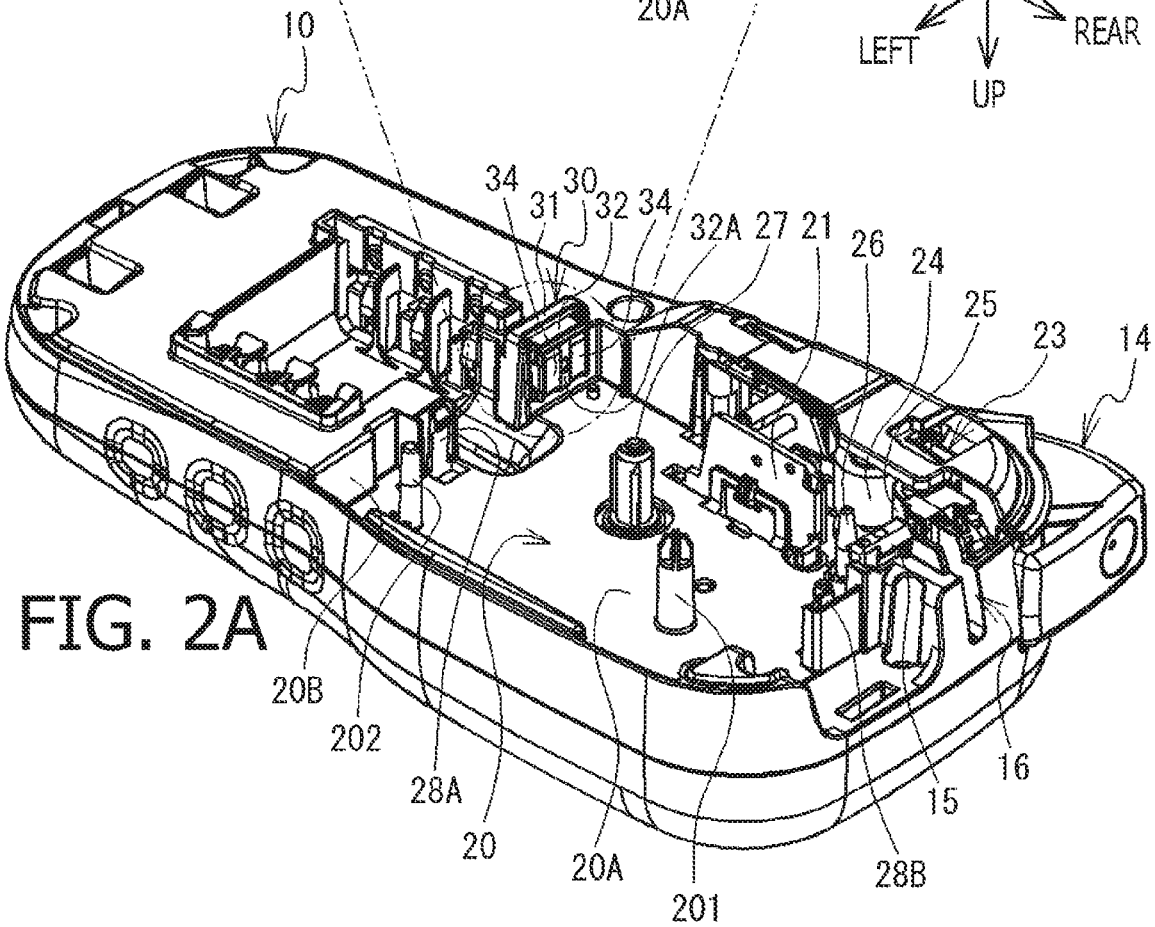
FIG. 2A is a perspective view of a casing of the printing device viewed from a lower left rear side.
Figure 3:
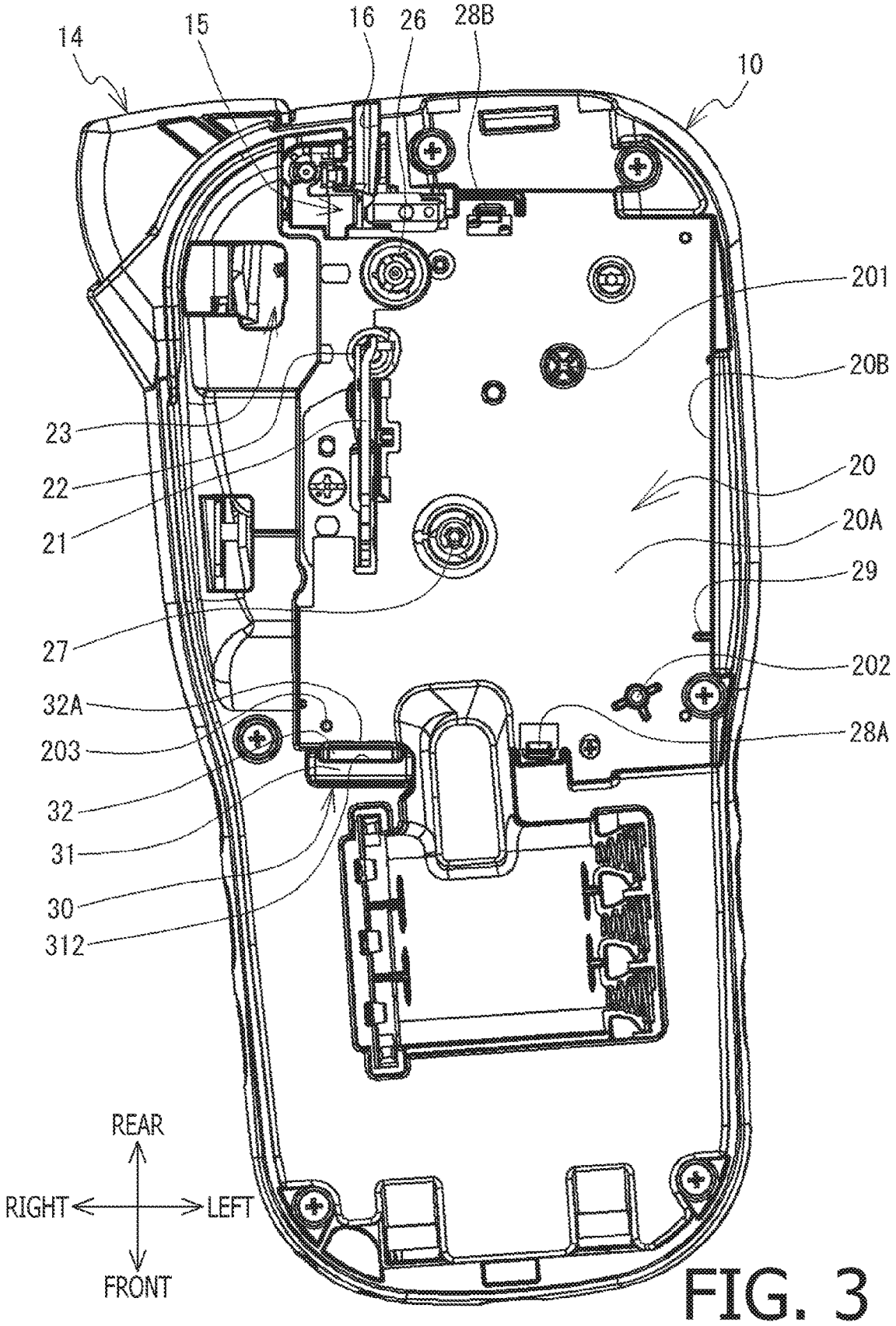
FIG. 3 is a bottom plan view of the casing.

As shown in FIGS. 2 and 3, the casing 10 is provided with a structure for mounting the tape cassette 5. The casing 10 is formed with a cassette attachment part 20. The cassette attachment part 20 is recessed upward from a lower surface of the casing 10, and has a bottom wall 20A and a side wall 20B. The bottom wall 20A has a substantially rectangular shape in downside plan view, and is perpendicular to the up-down direction. The side wall 20B extends downward from a periphery of the bottom wall 20A. The cassette attachment part 20 is formed such that the tape cassette 5 can be attached thereto and detached therefrom in the up-down direction.

In the cassette attachment part 20, a head holder 21, a platen holder 23, a tape driving shaft 26, a ribbon take-up shaft 27, engaging parts 28A and 28B, a rib 29 (see FIG. 3), guiding members 201 and 202, a protruding part 203, and a pressing part 30 are arranged. The head holder 21 is a plate-like member extending downward from a right portion of the bottom wall 20A. On a right side surface of the head holder 21, a thermal head 22 is arranged (see FIG. 3).

The platen holder 23 is arranged on a right portion of the cassette attachment part 20. The platen holder 23 is configured to be rotatable, about a front end portion thereof, in a substantially right-left direction. The platen holder 23 supports a platen roller 24 and a sub roller 25 such that each of the platen roller 24 and the sub roller 25 is rotatable in a counterclockwise direction in the downside plan view. The platen roller 24 is arranged to face the thermal head 22 from the right side. The sub roller 25 is arranged on the rear side and in the vicinity of the platen roller 24. The tape driving shaft 26 is arranged on the left side with respect to the sub roller 25, and extends downward from the bottom wall 20A. the ribbon take-up shaft 27 extends downward from a substantially central portion of the bottom wall 20A.

The engaging part 28A protrudes downward from a front end portion of the bottom wall 20A. The engaging part 28A is elastically deformable in the front-rear direction. The engaging part 28B protrudes downward from a rear end portion of the bottom wall 20A. The engaging part 28B is also elastically deformable in the front-rear direction. The rib 29 is arranged at a position on the front side with respect to the center, in the front-rear direction, of a left end portion of the cassette attachment part 20, and extends downward from the bottom wall 20A. A left end part of the rib 29 is connected to the side wall 20B.

The guiding member 201 is provided on a left rear side with respect to the ribbon take-up shaft 27, and extends downward from the bottom wall 20A. The guiding member 202 is provided on a left front corner part of the attachment part 20, and extends downward from the bottom wall 20A. Heights of the guiding members 201 and 202 with respect to the bottom wall 20A are substantially the same. Each of the guiding member 201 and 202 are tapered such that a diameter thereof decreases from an upper side (i.e., a proximal end side) to a lower side (i.e., a distal end side). The guiding members 201 and 202 engage with the tape cassette 5 when the tape cassette 5 is being attached to guide the tape cassette 5 to the attachment part 20. The protruding part 203 is provided at a right front corner of the attachment part 20, and protrudes downward from the bottom wall 20A. A height of the protruding part 203 from the bottom wall 20A is lower than the heights of the guiding members 201 and 201 from the bottom wall 20. The protruding part 203 supports the tape cassette 5 from the above (i.e., from the bottom wall 20A side) when the tape cassette 5 is attached to the attachment part 20. The pressing part 30 is arranged at a right front corner of the side wall 20B.

On a right rear side of and in the vicinity of the tape driving shaft 26, a cutting mechanism 15 is provided. The cutting mechanism includes a movable blade and a stationary blade (not shown). At a right rear corner of the casing 10, an operation lever 14 is provided. The operation lever 14 is configured to be push-operated inward. In response to inward push-operation of the operation lever 14, the movable blade of the cutting mechanism 15 is actuated to cut the tape located at a cutting position. On the rear side with respect to the cutting mechanism 15, a tape discharge port 16 is formed. The tape discharge port 16 is a through opening which penetrates the casing 10 in the front-rear direction. The tape discharge port 16 allows a portion of the tape cut out by the cutting mechanism 15 (which may be a printed portion of the tape) to be discharged outside the casing 10.

The printer 1 has a controller (not shown) inside the casing 10. The controller includes a CPU, a ROM, a RAM and the like, and controls the printing operation of the printer 1.

Next, referring to FIG. 2A, 2B, 3-7, the pressing part 30 will be described. As shown in FIGS. 2A, 2B and 3, the pressing part 30 and the cutting mechanism 15 are aligned in the front-rear direction. The pressing part 30 has a supporting part 31, the pressing plate 32 and an urging member 33 (see FIG. 4), and urges the tape cassette attached to the attachment part 20 rearward. The supporting part 31 is supported by the side wall 20B. the supporting part 31 is box-shaped having a substantially rectangular-parallelepiped shape, and has openings 311 and 312, and contacting members 31A and 31B (see FIG. 4). The opening 311 is formed on the rear surface of the supporting part 31, while the opening 312 is formed on the rear side of the lower surface of the supporting part 31.

Figure 4:
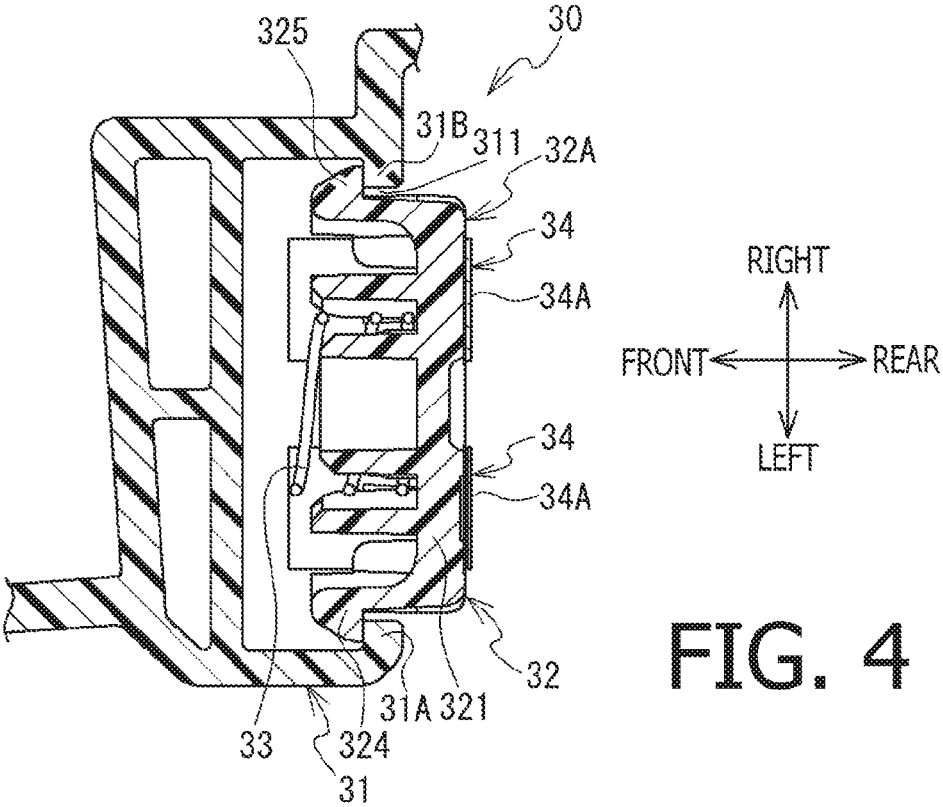
FIG. 4 is a cross-sectional view of a pressing part taken along a plane perpendicular to an up-down direction when a pressing plate is located at a first position.
Figure 5:
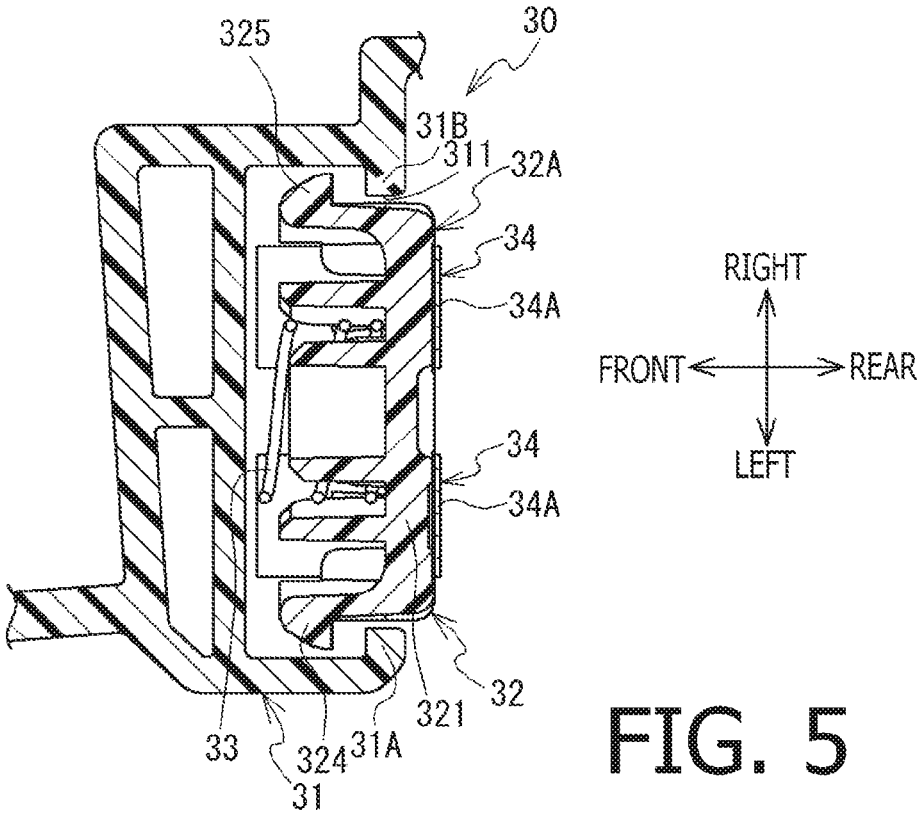
FIG. 5 is a cross-sectional view of the pressing part taken along a plane perpendicular to the up-down direction when the pressing plate is located at a second position.

As shown in FIGS. 4 and 5, the contacting member 31A protrudes rightward from the left end part of the opening 311, while the contacting member 31B protrudes leftward from the right end part of the opening 311.

The pressing plate 32 is arranged, inside the supporting part 31, at a position spaced downward from the bottom wall 20A (see FIGS. 2A and 2B). The pressing plate 32 is movably supported by the supporting part 31 so as to be movable in the front-rear direction between a first position (see FIG. 4) and a second position (see FIG. 5). When located at the first position, the pressing plate 32 protrudes rearward from a surface of the side wall 20 directed to a rear side (see FIG. 4). When located at the second position, a protruding amount of the pressing plate 32 from the surface of the side wall 20B directed to the rear side is smaller than that when located at the first position (see FIG. 5). When the pressing plate 32 is located at the second position, the pressing part 30 and the protruding part 203 (see FIG. 3) do not overlap in the up-down direction. According to the present embodiment, even when the pressing plate 32 is located at the first position, the pressing part 30 and the protruding part 203 do not overlap in the up-down direction. The pressing plate 32 contacts the tape cassette 5 when the tape cassette 5 is attached to the attachment part 20.

As shown in FIGS. 4 through 7, the pressing plate 32 has a rectangular-parallelepiped shape (i.e., box-shaped), which is opened frontward. The pressing plate 32 includes a first plate part 321, a second plate part 322, a third plate part 323 and regulating parts 324 and 325. The first plate part 321 is rectangular in rear view, and extends in a direction perpendicular to the front-rear direction. The second part 322 is rectangular in bottom view, and extends frontward from the lower end part of the first plate part 321. A connection part (hereinafter, referred to as a particular end part 32B) of the first plate part 321 and the second plate part 322 extends in an obliquely upper rear direction. An inclination angle θ of the particular end part 32B with respect to the front-rear direction is 45 degrees (see FIG. 6). The second plate part 322 is exposed downward through the opening 312 (see FIG. 2A). The third plate part 323 has a rectangular shape in plan view, and extends frontward from an upper end portion of the first plate part 321.

In the following description, a virtual plane C (see FIG. 7) will be referred to. The virtual plane C is defined as a position, on the pressing plate 32, of a plane passing a center F of load of gravity by an urging force of an urging member 33, and perpendicularly intersecting with a virtual line K which connects a left end part (hereinafter, referred to as a contacting part 36) of the particular end part 32B and the position of the center F of load of gravity (see FIG. 7). The contacting part 36 is located at a position shifted on the left side with respect to the position of the center F of load of gravity, and with respect to a pair of main body side conductive electrodes 34 which will be described later.

The regulating part 324 is provided on the same side as the contacting part 36 with respect to the virtual plane C. The regulating part 324 extends frontward from a central part, in the up-down direction, of the left end part of the first plate part 321. The front end part of the regulating part 324 protrudes leftward. The regulating part 325 is provided on a side opposite to the contacting part 36 with respect to the virtual plane C. the regulating part 325 extends frontward from the central part, in the up-down direction, of the right end part of the first plate part 321. The front end part of the regulating part 325 protrudes rightward.

On the rear surface (hereinafter, referred to as a pressing surface 32A) of the first plate part 321, a pair of (i.e., two) main body side conductive electrodes 34 are provided. Each of the pair of main body side conductive electrodes 34 is a metallic electrode, and is electrically connected to the controller of the printer 1 through a harness 39. The main body side conductive electrodes 34 are arranged in the right and left direction with a particular clearance therebetween. Each of the main body side conductive electrodes 34 are arranged such that a lower part thereof is exposed from the pressing surface 32A, while an upper part thereof extends frontward to enter the pressing plate 32 and further extends upward inside the pressing plate 32.

As shown in FIG. 2B, portions of the pair of main body side conductive electrodes 32A exposed from the pressing surface 32A (hereinafter, referred to as a pair of exposed parts 34A) has a rectangular shape elongated in the up-down direction, and the two exposed parts 34A have the same shape. Upper ends of the two exposed parts 34A are located at the same position in the up-down direction. Lower ends of the two exposed parts 34A are located at the same position in the up-down direction.

Figure 6:
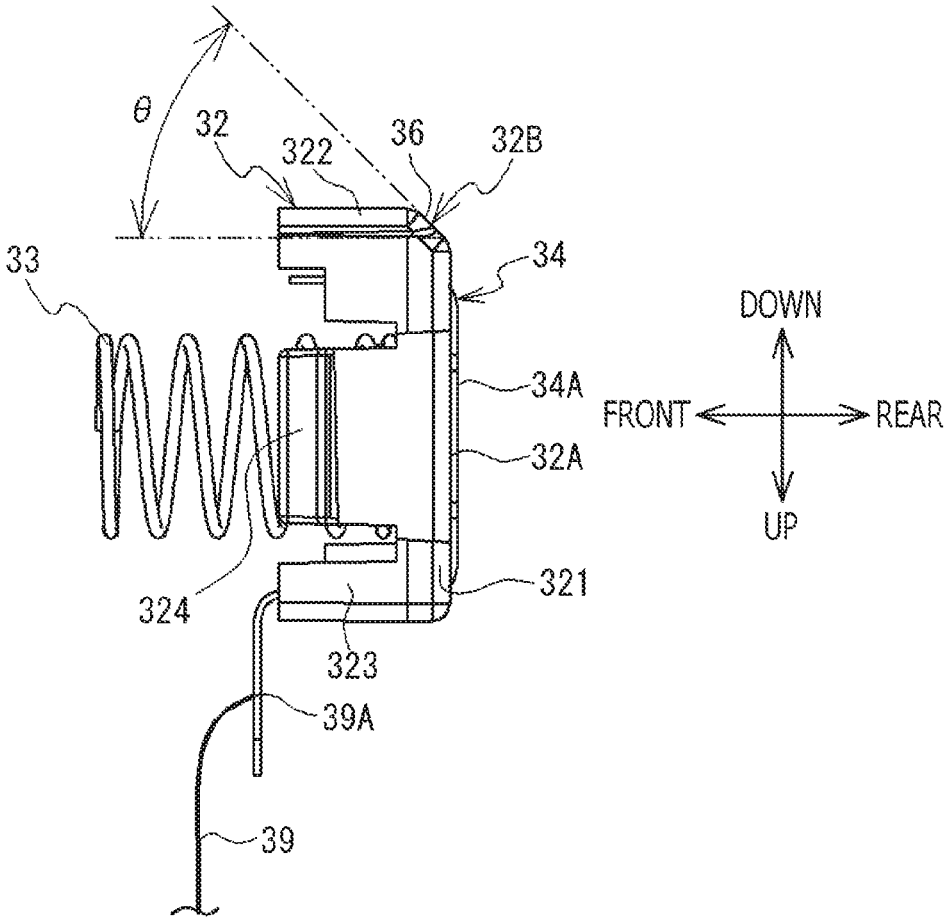
FIG. 6 is a left side view of the pressing part.
Figure 7:
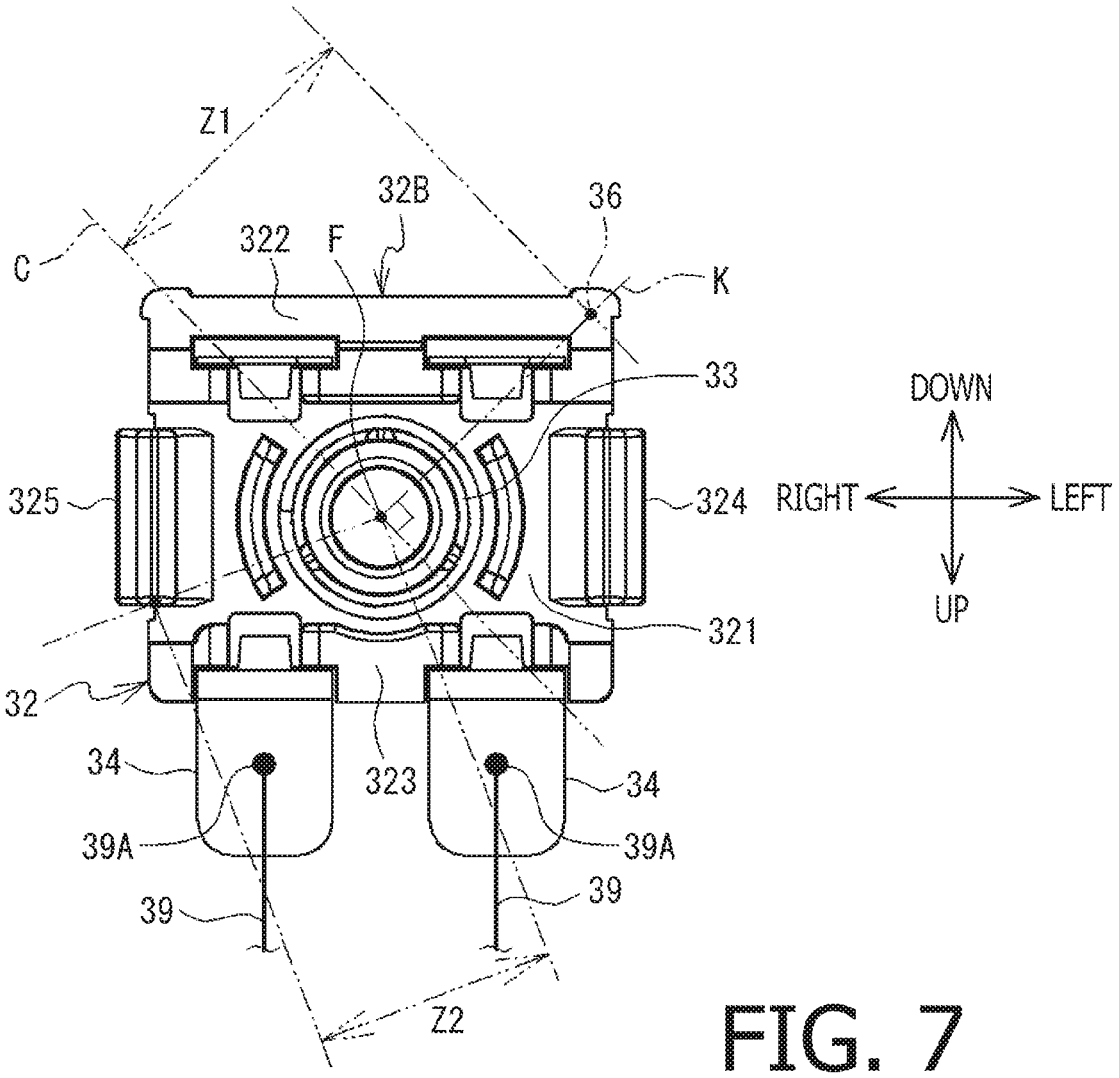
FIG. 7 is a front view of the pressing part.

As shown in FIGS. 6 and 7, an end of the harness 39 is connected, inside the pressing plate 32, to an upper part of the pair of main body side conductive electrodes 34 at a connecting part 39A. The harness 39 extends upward from the connecting part 39A, that is, extends in a direction perpendicular to the moving direction of the pressing plate 32. Therefore, according to a case where the harness 39 extends in the front-rear direction from the connecting part 39A, it is suppressed that the pressing plate 32 obstacles the movement of the pressing plated 32 in the front-rear direction. It is also suppressed that the harness 39 is bent and cut by the movement of the pressing plate 32.

The urging member 33 is a coil spring, which is arranged at a central position of the two exposed parts 34A in the right-left direction and in the up-down direction. One end of the urging member 33 is fixedly secured to the supporting part 31 (see FIG. 4). The other end of the urging member 33 is fixedly secured to a surface opposite to the pressing surface 32A of first plate part 321 at the center of the two exposed parts 34A (i.e., a front surface). The urging member 33 is configured to urge the pressing plate 32 rearward so as to move in a direction from the second position (see FIG. 5) to the first position (see FIG. 4).

In the center of the urging member 33, a shaft for guiding an elastic deformation of the urging member 33 is not inserted. A line passing the center of the urging member 33 and extending in the front-rear direction also passes the center of the pair of exposed parts 34A. That is, a position of the center F of load of gravity due to the urging force by the urging member 33 coincides with a position of the center of the pair of exposed parts 34A both in the right-left direction and in the up-down direction. Further, the center of the pair of exposed parts 34A both in the right-left direction and in the up-down direction coincides with an intersection point of diagonals of a quadrilateral defined by upper right corner and lower right corner of a right side exposed part 34A of the pair of exposed parts 34A and an upper left corner and a lower left corner of a left side exposed part 34A of the pair of exposed parts 34A.

A distance Z1 between the center F of load of gravity and the contacting part 36 is larger than a distance Z2 between the center F of load of gravity and the regulating parts 325. According to the illustrative embodiment, the distance Z1 is 9 mm, while the distance Z2 is 7 mm. Therefore, a ratio of the distance Z2 to the distance Z1 is 7/9.

When the pressing plate 32 is located at the first position, the contacting members 31A and 31B contact the regulating parts 324 and 325 from the rear side, respectively. According to this configuration, the pressing plate 32 is prevented from moving rearward from the first position by the urging force of the urging member 33.

Figure 8:
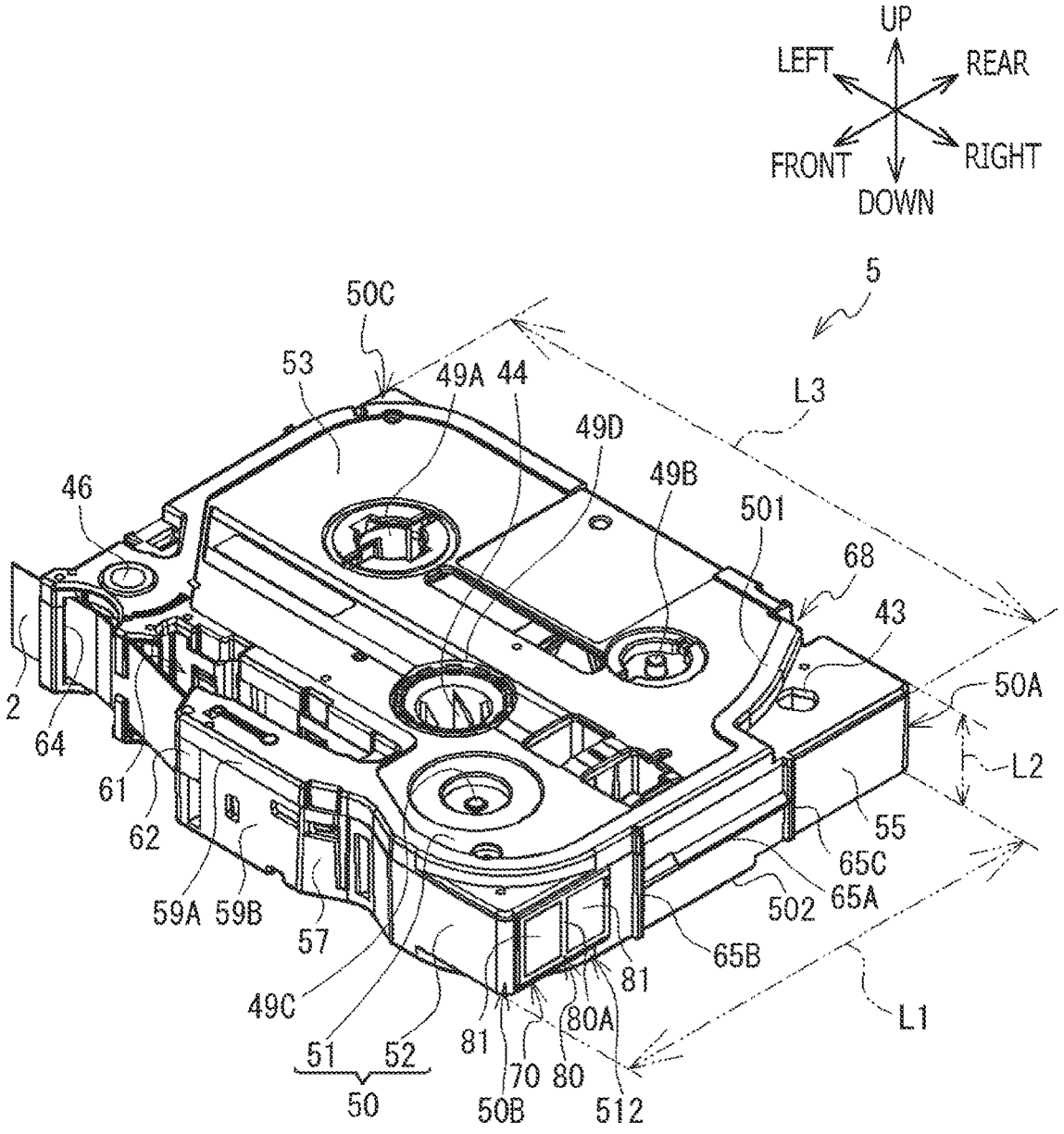
FIG. 8 is a perspective view of the tape cassette viewed from an upper right front side.

Next, the tape cassette 5 will be described in detail, referring to FIGS. 8-10. In the following description, an upper left side, a lower right side, a lower left side, an upper right side, an upper side and a lower side in FIG. 8 will be defined as a left side, a right side, a front side, a rear side, an upper side, a lower side of the tape cassette 5, respectively. As shown in FIG. 8, the tape cassette 5 has a cassette case 50. The cassette case 50 has a substantially rectangular parallelepiped box shape, and has an upper case 51 and a lower case 52. The upper case 51 and the lower case 52 are arranged in the up-down direction, the upper case 51 being attached on the upper side of the lower case 51. The upper case 51 has an upper wall 53 and a peripheral wall 59A. The lower case 52 has a lower wall 54 (see FIG. 9A) and a peripheral wall 59B. Each of the upper wall 53 and the lower wall 54 extends in both the front-rear direction and the right-left direction. The lower wall 54 is arranged below the upper wall 53 with being aligned thereto.

The peripheral wall 59A extends downward from a periphery of the upper wall 53. The peripheral wall 59B extends upward from a periphery of the lower wall 54. The peripheral walls 59A and 59B form, in a state where the upper case 51 is coupled to the lower case 52, a right wall 55, a left wall 56, a front wall 57 and a rear wall 58 (see FIG. 9A). Each of the right wall 55 and the left wall 56 extends in both the front-rear direction and the up-down direction. The left wall 56 is arranged on the left side with respect to the right wall 55. Each of the front wall 57 and the rear wall 58 extends in both the up-down direction and the right-left direction. The rear wall 58 is arranged on the rear side with respect to the front wall 57.

The upper wall 53, the lower wall 54, the right wall 55, the left wall 56, the front wall 57 and the rear wall 58 are outer walls each facing inside the cassette case 50. A distance L1 between the front wall 56 and the rear wall 57 is larger than a distance L2 between the upper wall 53 and the lower wall 54. A distance L3 between the right wall 55 and the left wall 56 is larger than the distance L1.

Figure 9A:
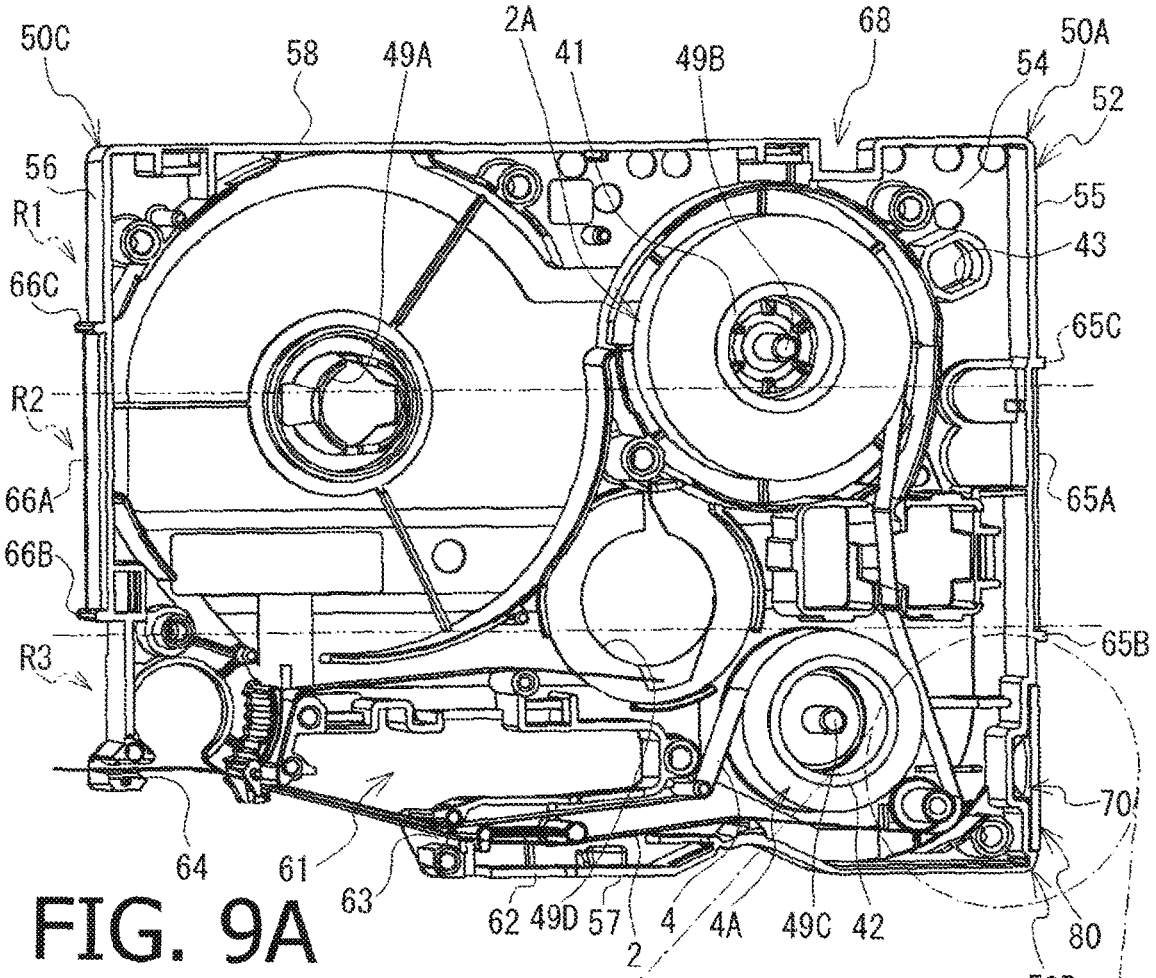
FIG. 9A is a perspective view of a receptor type tape cassette viewed from a substantially upper side with an upper case being removed.

As shown in FIG. 9A, a head insertion part 61 is formed on the front wall 57. The head insertion part 61 is configured such that a portion of the front wall 57 is recessed rearward from the vicinity of the left end of the front wall 57 and extends rightward. A portion of the front wall 57 extending on the front side with respect to the head insertion part 61 will be referred to as an arm part 62. On a left end portion of the arm part 62, a first discharge port 63 is formed. The first discharge port 63 is an opening extending in the up-down direction, and the tape and an ink ribbon 4 are discharged, through the first discharge port 63, from inside to outer side of the cassette case 50.

A second discharge port 64 is formed on the left wall 56 at a front end part thereof. In the following description, each of the right wall 55 and the left wall 56 is equally divided in the front-rear direction into three areas, which will be referred to as a first area R1, a second area R2 and a third area R3 in an order from the rear side to the front side. The second discharge port 64 is located, within the third area R3, on a downstream side, in a tape conveying direction, with respect to the first discharge port 63. The second discharge port 64 is an opening extending in the up-down direction. A portion of the tape discharged externally through the second discharge port 64 is guided to the tape discharge port 16.

Figure 9B:
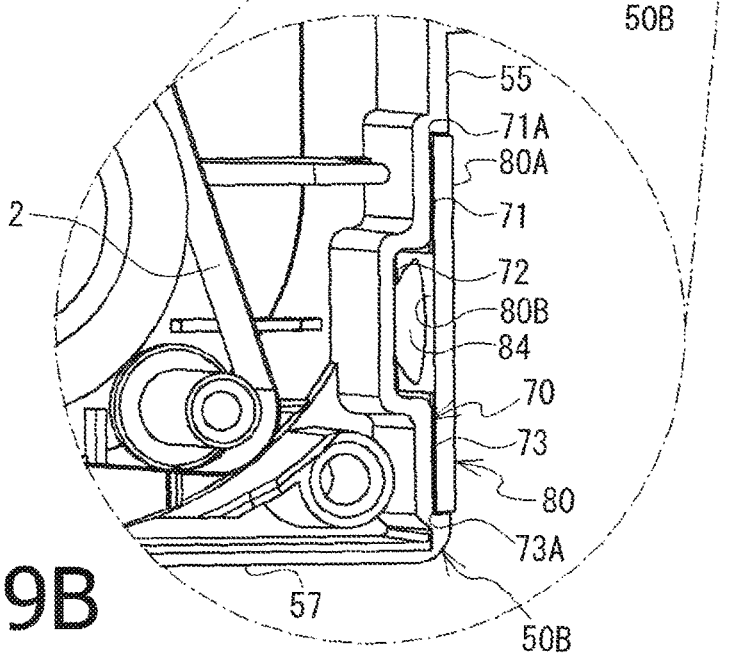
FIG. 9B is an enlarged perspective view of a circled portion of FIG. 9A.

As shown in FIGS. 8, 9A and 9B, an arrangement part 70 and ribs 65A, 65B and 65C are provided to the right wall 55. The arrangement part 70 is located within the third area R3. On the arrangement part 70, a substrate 80 is arranged.

The ribs 65A, 65B and 65C are formed at positions on the rear side with respect to the substrate 80, and protrude outward from the cassette case 50, that is, ribs 65A, 65B and 65C are formed to protrude rightward from the right wall 55 to a right side with respect to the substrate 80. The rib 65A is formed to extend, at a central portion of the right wall 59 in the up-down direction, from the vicinity of a rear side of the arrangement part 70 to a rear side with respect to the central portion of the right wall 55 in the front-rear direction. The rib 65B is connected to a front end of the rib 65A, and extends in the up-down direction between the upper end and the lower end of the right wall 55. The rib 65C is connected to a rear end of the rib 65A, and extends in the up-down direction between the upper end and the lower end of the right wall 55.

As shown in FIG. 9A, ribs 66A, 66B and 66C are provided onto the left wall 56. The ribs 66A, 66B and 66C are formed at positions on the rear side with respect to the substrate 80, and protrude outward from the cassette case 50, that is, ribs 66A, 66B and 66C are formed to protrude leftward from the left wall 56 to a left side with respect to the substrate 80. The rib 66A extends in the right-left direction centering on a central position in the front-rear direction. The rib 66B is connected to a front end portion of the rib 66A and extends in the up-down direction between an upper end and a lower end of the left wall 56. The rib 66C is connected to a rear portion of the rib 66A and extends in the up-down direction between an upper and a lower end of the left wall 56.

As shown in FIG. 6, the cassette case 50 has common parts 50A, 50B and 50C. Each of the common parts 50A, 50B and 50C is arranged between the upper end 501 of the cassette case 50 and the lower end 502 of the cassette case 50 in the up-down direction. Lengths of the common parts 50A, 50B and 50C in the up-down direction are the same regardless of the tape width. The common part 50A is a right rear corner part of the cassette case 50, and includes a rear end portion of the right wall 55 and a right end portion of the rear wall 58. The common part 50B is a front right corner part of the cassette case 50, and includes a front end portion of the right wall 55 and the right end portion of the front wall 57. The common part 50C is a rear left part of the cassette case 50, and includes a rear end portion of the left wall 56 and the left end portion of the rear wall 58.

A portion of the bottom wall 54 in the vicinity of the common part 50B is recessed upward. At this portion, a surface (hereinafter, referred to as a contacting surface 51) directed to outer side of the cassette case 50 is formed. The lower end part 512 of the contacting surface 512 is arranged at a lower level than the lower end part of the common part 50B. The contacting surface 512 is configured such that one end thereof is connected to the right wall 55, while the other end thereof is connected to the front wall 57. That is, the contacting surface 512 connects the right wall 55 and the front wall 57. The contacting surface 512 is curved from the vicinity of the front side of the rear end part of the arrangement part 70 to oblique left front side. The contacting part 512 is arc-shaped having a center of curvature on a center side of the cassette case 50 with respect to the contacting surface (that is, on a side opposite to the substrate 80 or the common part 50B). Only the rear end part of the contacting part 512 (i.e., a part connected with the right wall 55) overlaps the arrangement part 70 and the substrate 80 in the up-down direction.

As shown in FIG. 9A, a recess 68 is formed on the rear wall 58. The recess 68 is formed on the left side with respect to the common part 50A and adjoining thereto. The recess 68 is recessed frontward from the rear wall 58 and extends in the up-down direction.

As shown in FIG. 8 and FIG. 9A, the cassette case 50 has a guide hole 43, a tape driving roller 46 and supporting parts 49A-49D. The guide hole 43 penetrates the right rear corner part of the cassette case 50 in the up-down direction. The tape driving roller 46 has a cylindrical shape extending, in the up-down direction, between the upper wall 53 and the lower wall 54, and is arranged in a front left corner of the cassette case 50. The tape driving roller 46 is rotatably supported by the upper wall 53 and the lower wall 54. The supporting part 49A is a cylindrical member extending, in the up-down direction, between the upper wall 53 and the lower wall 54. The supporting parts 49B and 49C are shaft members extending, in the up-down direction, between the upper wall 53 and the lower wall 54. The supporting part 49D penetrates both the upper wall 53 and the lower wall 54 in the up-down direction.

As shown in FIG. 9A, the supporting part 49A is arranged on the oblique rear right side with respect to the tape driving roller 46, and rotatably supports a first tape spool (not shown). On the first tape spool, a first tape is wound. The supporting part 49B is arranged on the right side with respect to the supporting part 49A, and rotatably supports a second tape spool 41. On the second tape spool 41, a second tape is wound. The supporting part 49C is arranged on an oblique front right side with respect to the supporting part 49B, and rotatably supports a ribbon spool 42. On the ribbon spool 42, unused ink ribbon 4 is wound. The supporting part 49D is arranged on an oblique front right side with respect to the supporting part 49B, and rotatably supports a ribbon take-up spool 44 (see FIG. 8). The used ink ribbon 4 is taken up by the ribbon take-up spool 44, and wound thereon.

The tape cassette 5 could be of a receptor type, a thermal type, a laminate type, a tube type and the like by changing the type of the tape accommodated in the cassette case 50 and depending on presence/absence of the ink ribbon 4 in the cassette 5. FIG. 9A shows an example of the receptor type tape cassette 5. In the receptor type tape cassette 5, the supporting part 49B supports the second tape spool 41 on which a single-side adhesive tape 2 is wound as a second tape (hereinafter, referred to as a tape roll 2A). The supporting part 49C rotatably supports the ribbon spool 42 on which an unused ink ribbon 4 is wound (hereinafter, referred to as an ink ribbon roll 4A). It is noted that, since the receptor type tape cassette 5 does not use the first tape, the supporting part 49A does not support the first tape spool.

The tape roll 2A and the ink ribbon roll 4A are supplying sources of the single-side adhesive tape 2 and the ink ribbon 4, respectively. The tape roll 2A and the ink ribbon roll 4A are accommodated inside the cassette case 50 such that the width direction of the single-side adhesive tape 2 and the ink ribbon 4 coincides with the up-down direction of the cassette case 50.

Next, referring to FIGS. 8, 9A, 9B, 10A, 10B and 11, the arrangement part 70 and the substrate 80 will be described. As shown in FIG. 9A, the arrangement part 70 is recessed leftward from the right wall 55. The arrangement part 70 is arranged at a position, on the right wall 55, next to the front wall 57, that is, at the common part 50B. The vicinity of the front end part of the arrangement part 70 overlaps the second discharge port 64 when viewed in the right-left direction.

As shown in FIGS. 10A and 10B, the arrangement part 70 extends in the up-down direction between the vicinity of a lower side of the upper end part of the right wall 55 and the vicinity of an upper side of the lower end part of the right wall 55. That is, the arrangement part 70 does not extend to the upper wall 53 or the lower wall 54.

As shown in FIGS. 9A and 9B, the arrangement part 70 has a first wall 71, the relief recess 72 and a second wall 73. The first wall 71, the relief recess 72 and the second wall 73 are arranged in this order from the rear side to the front side, and form a bottom wall of the arrangement part 70. The first wall 71 and the second wall 73 are arranged on the left side with respect to the right surface of the right wall 55, and extends in parallel with the right wall 55. The relief recess 72 is formed on the third area R3, and recessed leftward from the first wall 71 and the second wall 73.

Figure 10:
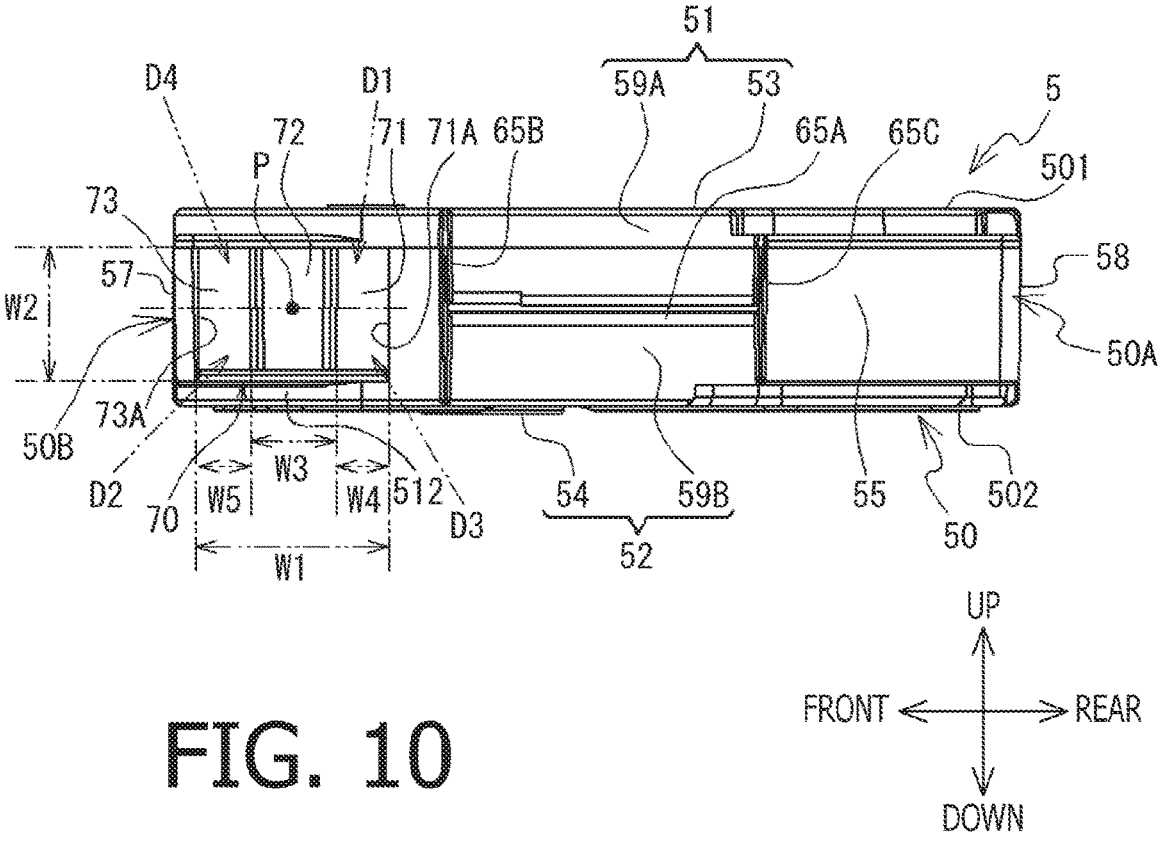
FIG. 10 is a right side view of the tape cassette.

In the following description, assuming that the first wall 71 and the second wall 73 are equally divided in the up-down direction, an upper area of the first wall 71, a lower are of the second wall 73, a lower area of the first wall 71 and an upper area of the second wall 73 will be referred to as a first arrangement area D1, a second arrangement area D2, a third arrangement area D3 and a fourth arrangement area D4, respectively, as shown in FIG. 10.

A surface of each of the first arrangement area D1, the second arrangement area D2, the third arrangement area D3 and the fourth arrangement area D4 is a planar surface. It is noted that, in the description, the planar surface is defined as not only a completely planar surface but a surface which does not form a curved surface and does not have a convex part. Thus, according to the above definition, the planar surface may include a surface formed with a concave part.

In the following description, a center of an area composed by the first wall 71, the relief recess 72 and the second wall 73 in side view (i.e., an area which is formed when the arrangement part 70 is projected in the right-left direction) will be referred to as a "center P." The center P coincides with an intersecting point of diagonal lines of a rectangle defined by a lower rear corner of the first wall 71, an upper rear corner of the first wall 71, a lower front corner of the second wall 73 and an upper front corner of the second wall 73 in side view. A surface shape of the first arrangement area D1 and a surface shape of the second arrangement area D2 are symmetrical with respect to the center P. Similarly, a surface shape of the third arrangement area D3 and a surface shape of the fourth arrangement area D4 are symmetrical with respect to the center P.

As shown in FIG. 8, the substrate 80 has a rectangular shape having longer sides and shorter sides. Further, the substrate 80 has a first surface 80A and a second surface 80B (see FIG. 11). The first surface 80 and the second surface 80 face opposite sides. On the first surface 80A, a pair of (i.e., two) cassette side conductive electrodes 81 are provided. Each of the two cassette side conductive electrodes 81 is a metallic electrode. The two cassette side conductive electrodes 81 are arranged in a longer side direction (hereinafter, referred to as a Y1 direction: see FIG. 11) of the substrate 80 with a particular clearance therebetween. Each of the two cassette side conductive electrodes 81 has a rectangular shape elongated in a shorter side direction (hereinafter, referred to as a Y2 direction: see FIG. 11) of the substrate 80. The two cassette side conductive electrodes 81 have the same shapes. One side ends, in the Y2 direction (e.g., the upper side in FIG. 11), of the two cassette side conductive electrodes 81 are located at the same positions in the Y2 direction. Further, the other side ends, in the Y2 direction (e.g., the lower side in FIG. 11), of the two cassette side conductive electrodes 81 are located at the same positions in the Y2 direction.

A length, in the longer side direction (i.e., Y2 direction), of the pair of cassette side conductive electrodes 81 is shorter than a length, in the longer side direction (i.e., the up-down direction in FIG. 2A and FIG. 2B) of the pair of main body side conductive electrodes 34 (see FIG. 2A and FIG. 2B). Further, a length, in the shorter side direction (i.e., Y1 direction), of the pair of cassette side conductive electrodes 81 is longer than a length, in the shorter side direction (i.e., the right-left direction in FIG. 2A and FIG. 2B) of the pair of main body side conductive electrodes 34 (see FIG. 2A and FIG. 2B). Furthermore, a distance between the two cassette side conductive electrodes 81 is shorter than a distance between the two main body side conductive electrodes 34.

Figure 11:
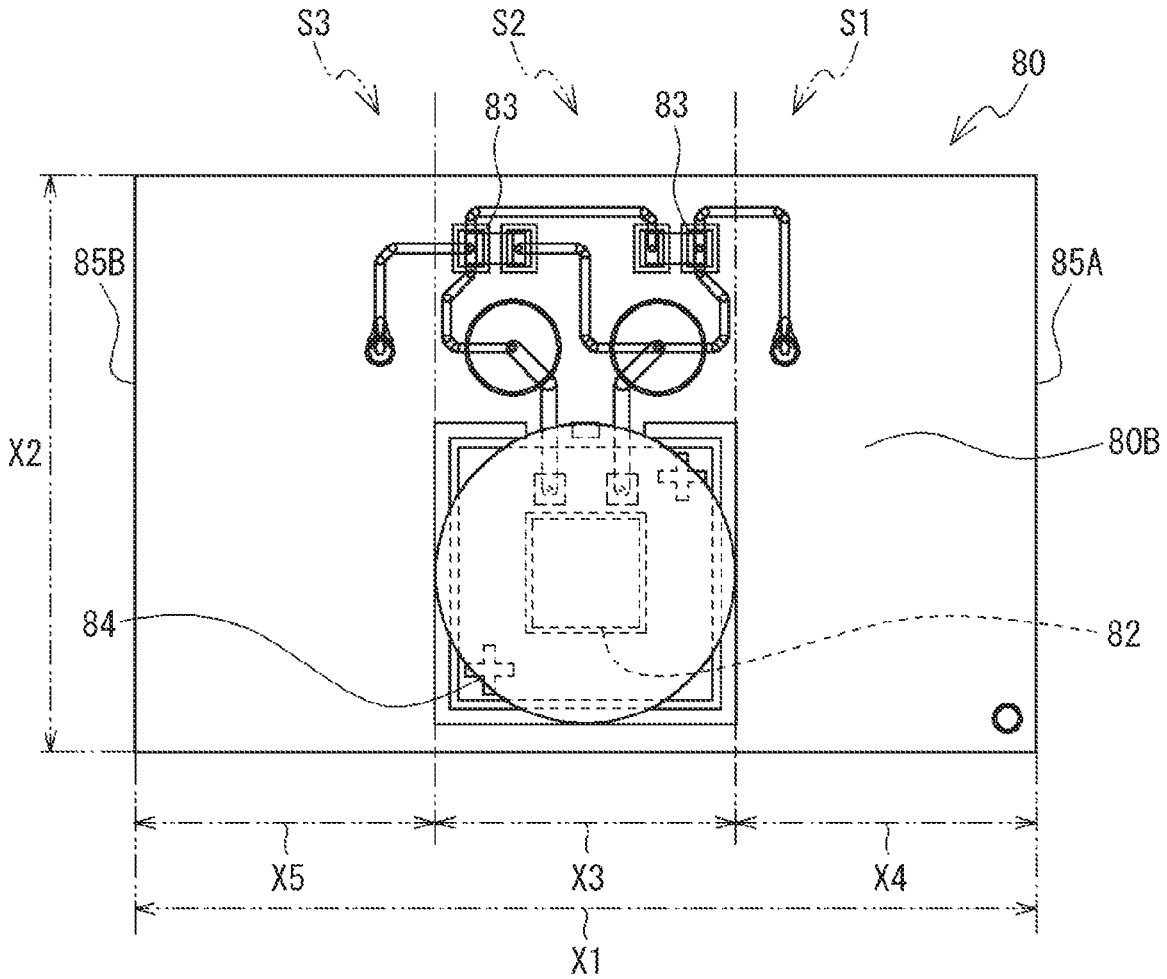
FIG. 11 shows a substrate viewed from a second surface side.
Figure 11:
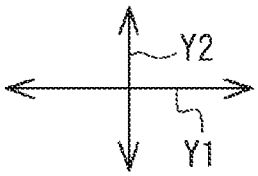

As shown in FIG. 11, an IC chip 82, two condensers 83 and a molded part 84 are provided on the second surface 80B. The IC chip 82 is electrically connected to the two cassette side conductive electrodes 81 via the two condensers 83, respectively. The IC chip 82 is configured to store various pieces of information such as information of the type of the tape cassette 5 (e.g., the receptor type), information of the type of the tape (e.g., the color, the width) and the like. The two condensers 83 are connected to pass electric signals having a particular frequency. The molded part 84 is a resin member covering the IC chip 82 from a side opposite to the second surface 80B to protect the same.

In the following description, a right-hand side of FIG. 11 will be referred to as a "one-way side" in the Y1 direction, and a left-hand side of FIG. 11 will be referred to as the "other-way side" in the Y1 direction. Further, the second surface 80B is equally divided into three areas in the Y1 direction and the three divided areas will be referred to as "a first substrate area S1," "a second substrate area S2" and "a third substrate area S3" in this order from one side (i.e., the right-hand side in FIG. 11) to the other side (i.e., the left-hand side in FIG. 11) in the Y1 direction. The IC chip 82, the condensers 83 and the molded part 84 are all arranged within the second substrate area S2.

As shown in FIGS. 10 and 11, a distance W1 (i.e., the length of the arrangement part 70 in the front-rear direction), in the front-rear direction, between a rear end part 71A of the first wall 71 and a front end part 73A of the second wall 73 is slightly larger than a length X1, in the Y1 direction, of the substrate 80. A length W2, in the up-down direction, of the first wall 71 and the second wall 73 is slightly larger than a length X2, in the Y2 direction, of the substrate 80. A length W3, in the front-rear direction, of the relief recess 72 is larger than a length X3, in the Y1 direction, of the molded part 84.

Hereinafter, an end part of the substrate 80 on the one side in the Y1 direction (i.e., the right-hand side in FIG. 11) will be referred to as a "first substrate end part" 85A, and an end part of the substrate 80 on the other side in the Y1 direction (i.e., the left-hand side in FIG. 11) will be referred to as a "second substrate end part" 85B. It is noted that a length W4 of the first wall 71 in the front-rear direction and a length W5 of the second wall 73 in the front-rear direction are shorter than a distance X4, in the Y1 direction, between the molded part 84 (specifically, one end of the molded part 84 in the Y1 direction) and the first substrate end part 85A, and a distance X5, in the Y1 direction, between the molded part 84 (specifically, the other end of the molded part 84 in the Y1 direction) and the second substrate end part 85B, respectively.

As shown in FIGS. 9A and 9B, the substrate 80 is arranged at the arrangement part 70 with the Y1 direction (see FIG. 11) being parallel to the front-rear direction of the tape cassette 5, and the first surface 80A facing rightward. Therefore, the first surface 80A is exposed to the outer side of the tape cassette 5. It is noted that the substrate 80 can be arranged at the arrangement part 70 with the one side part in the Y1 direction (i.e., the right-hand side part in FIG. 11) being directed either rearward or frontward of the tape cassette 5. Between each of the first wall 71 and the second wall 73, and the second surface 80B, an adhesion layer (not shown) is provided. The adhesive layer is formed by, for example, an adhesive, a both-side adhesive tape, or the like. The substrate 80 is arranged to be bridged between the first wall 71 and the second wall 73 with the adhesive layer being sandwiched therebetween. The molded part 84 and the IC chip 82 are arranged at the relief recess 72.

Hereinafter, a description will be made based on a case where the substrate 80 is arranged at the arrangement part 70. The first surface 80A is arranged on the right side with respect to the right wall 55. That is, the substrate 80 protrude rightward with respect to the right wall 55. A distance, in the right-left direction, between the first surface 80A and the right wall 55 (i.e., a protruding among of the substrate 80 with respect to the right wall 55 of the substrate 80) is smaller than a distance, in the up-down direction, between the lower end part of the substrate 80 and the lower end part of the contacting surface 512. The substrate 80 is arranged on the third area R3. The center of the substrate 80 in the front-rear direction is on the rear side with respect to the center of the second discharging port 64 in the front-rear direction. A part of the substrate 80 overlaps the second discharging port 64 in the right-left direction. Specifically, the front side conductive electrode of the pair of cassette side conductive electrodes 81 overlaps the second discharging port 54 in the right-left direction.

Next, referring to FIGS. 12A-12D, 12BE, 12CE and 13, a general flow of attaching the tape cassette 5 to the attachment part 20, and a printing operation performed by the printing device 1 will be described. FIG. 12A shows a cross-sectional view of the printing device 1 and the tape cassette 5 taken along line A4-A4 of FIG. 13 when insertion of the guiding members 201 and 202 into the supporting part 49A and the guide hole 43 starts. FIG. 12B is a cross-sectional view of the printing device 1 and the tape cassette 5 taken along line A2-A2 of FIG. 13 when the contacting surface 512 is about to contact the contacting part 36, and FIG. 12BE is an enlarged cross-sectional view of a circled portion in FIG. 12B. FIG. 12C is a cross-sectional view of the printing device 1 and the tape cassette 5 taken along line A1-A1 of FIG. 13 when the substrate 80 starts contacting the center F of load of gravity of the pressing plate 32, and 12CE is an enlarged cross-sectional view of a circled portion in FIG. 12C. FIG. 12D is a cross-sectional view of the printing device 1 and the tape cassette 5 taken along line A3-A3 of FIG. 13 when engagement of the engaging parts 28A and 28B with the ribs 65A and 66A starts. The user attaches the tape cassette 5 to the attachment part 20 such that the substrate 80 faces the pressing part 30.

As shown in FIGS. 12A-12D, 12BE and 12CE, a distance H, in the up-down direction, between the bottom wall 20A and the center, in the up-down direction, of the tape cassette 5 when insertion of the guiding members 201 and 202 into the supporting part 49A and the guide hole 43 starts is larger than a distance H2, in the up-down direction, between the bottom wall 20A and the center, in the up-down direction, of the tape cassette 5 when the contacting surface 512 contacts the contacting part 36. The distance H2 is larger than a distance H3, in the up-down direction, between the bottom wall 20A and the center, in the up-down direction, of the tape cassette 5 when the substrate 80 starts contacting the center F of load of gravity of the pressing plate 32. Further, the distance H3 is larger than a distance H4 in the up-down direction, between the bottom wall 20A and the center, in the up-down direction, of the tape cassette 5 when engagement of the engaging parts 28A and 28B with the ribs 65A and 66A starts.

Therefore, in a process when the tape cassette 5 is attached to the attachment part 20, insertion of the guiding members 210 and 201 to the supporting part 49 and the guide hole 43 is started firstly (see FIG. 12A). Then, as the guiding members 201 and 202 engage with the tape cassette 5, a position of the tape cassette 5 both in the front-rear direction and the right-left direction with respect to the attachment part 20 is determined, and guiding of the tape cassette 5 to the attachment part 20 is started. Thereafter, the tape cassette 5 starts contacting the pressing plate 32 (see FIG. 12B). At this stage, the contacting surface 512 makes a point contact with the contacting part 36 from the down side. Since the inclination angle θ is 45 degrees, and a distance between the first surface 80A and the right wall 55 in the right-left direction is smaller than a distance between the lower end part of the substrate 80 and the lower end part of the contacting surface 512 in the up-down direction, it is ensured that the contacting surface 512 can contact the contacting part 36. In this state, the center of curvature of the contacting surface 512 is located on a side opposite to the contacting part 36 with respect to the contacting surface 512.

Since the particular end part 32B is inclined in an obliquely upper rear direction, the pressing plate 32 is pushed frontward by the contacting surface 512 at the contacting part 36. The regulating parts 324 is spaced frontward from the contacting member 31A. At this stage, the regulating part 325 is located on a side opposite to the contacting part 36 with respect to the virtual plane C, the regulating part 325 stays contacting the contacting member 31B. Therefore, a principle of leverage functions such that the regulating 325 serves as a fulcrum, the contacting part 36 serves as a point of effort and the center F of load of gravity serves as a point of load. The pressing plate 32 moves frontward against the urging force by the urging member 33 toward from the first position (see FIG. 4) toward the second position (see FIG. 5).

After the contacting surface 512 makes the point contact with the contacting part 36, the tape cassette 5 moves toward the attachment part 20 with keeping the substrate 80 contacting the pressing surface 32A. Then, contacting of the substrate 80 to the center F of load of gravity of the pressing plate 32 is started (see FIG. 12C). Thereafter, engaging of the ribs 65A and 66A with the respective engaging parts 28A an 28B (see FIG. 12D).

As shown in FIG. 13, the thermal head 22 is inserted in the head insertion part 61. The tape driving shaft 26 is inserted in the tape driving roller 46. The ribbon take-up shaft 27 is inserted in the ribbon take-up spool 44. The rib 29 is inserted in the recess 68. It is noted that a tape cassette which is not formed with the recess 68 cannot be attached to the attachment part 20 since the rib 29 interferes with such a tape cassette. Therefore, by the recess 68 and the rib 29, a tape cassette different from the tape cassette 5 is prevented from being attached to the attachment part 20.

Next, engagement of the engaging parts 28A and 28B with tee ribs 65A and 66A is completed. The engaging parts 28A and 29B regulates the movement of the tape cassette 5 in the up-down direction by engaging with the ribs 65A and 66A, respectively. Then, attachment of the tape cassette 5 to the attachment mart 20 is completed.

In a state where the tape cassette 5 is attached to the attachment part 20, the upper case 51 is arranged on a side opposite to the bottom wall 20A with respect to the lower case 52. The lower wall 54 faces the bottom wall 20A in the up-down direction. The protruding part 203 supports the common part 50B from the bottom wall 20A side. With this configuration, a distance from the bottom wall 20A to the center, in the up-down direction, of the tape cassette 5 is constant regardless of the tape width. It is noted that the right-left direction of the printing device 1, the front-rear direction of the tape cassette 5, and the Y1 direction of the substrate 80 coincide with each other.

The pair of (i.e., two) cassette side conductive electrodes 81 and the pair of (i.e., two) main body side conductive electrodes 34 respective make surface contact with each other, thereby electrically connected. The contacting surface 512 makes a point contact with the tape cassette 5, and the substrate 80 makes a surface contact with the pressing surface 32A. That is, a contacting range, in the right-left direction, between the tape cassette 5 and the contacting part 36 (i.e., a contacting range, in the right-left direction, in which the tape cassette 5 firstly contacts the pressing plate 32) is a point, while a contact range, in the right-left direction, between the tape cassette 5 and the pressing plate 32 when the tape cassette 5 has been attached to the attachment part 20 is a line extending between the left end part and the right end part of the pressing surface 32A. Therefore, the contact range, in the right-left direction, between the tape cassette 5 and the contacting part 36 is smaller than the contacting range, in the right-left direction, between the tape cassette 5 and the pressing plate 32.

In a state where the pair of (i.e., two) cassette side conductive electrodes 81 and the pair of (i.e., two) main body side conductive electrodes 34 face in the front-rear direction, and contact with each other to be electrically connected, the printing device 1 is in a state to be communicatable with the tape cassette 5. Specifically, the CPU of the printing device 1 is configured to receive a signal from the IC chip 82 in accordance with a generally-known modulating method using a voltage difference between each of the pair of (i.e., two) main body side conductive electrodes 34 and each of the pair of (i.e., two) cassette side conductive electrodes 81.

When the cover 19 (see FIG. 1) is closed with respect to the casing 10, the platen holder 23 rotates leftward. The platen roller 24 sandwiches the single-side adhesive tape 2 and the ink ribbon 4, which are overlaid each other, in association with the thermal head 22. The sub roller 25 sandwiches the single-side adhesive tape 2 in association with the tape driving roller 46.

When the printing operation by the printing device 1 is started, the tape driving shaft 26 and the ribbon take-up shaft 27 are driven to rotate in synchronous with the rotation of a motor (not shown). In association with rotation of the tape driving shaft 26, the tape driving roller 46 rotates, thereby the sub roller 26 being driven to rotate. When the tape driving roller 46 and the sub roller 25 rotate, the single-side adhesive tape 2 is drawn out from the tape roller 2A and is conveyed. In association with rotation of the ribbon take-up shaft 27, the ribbon take-up spool 44 rotates. As the ribbon take-up spool 44 rotates, the ink ribbon 4 is drawn out from the ribbon roll 4A. Between the platen roller 24 and the thermal head 22, the ink ribbon 4 overlaid with the signal-adhesive tape 2, and a printing operation to perform printing on the single-side printing device with the thermal head 22 is performed.

As described above, when the tape cassette 5 starts contacting the pressing plate 32, the contacting surface 512 makes the point contact with the contacting part 36. Since the contacting part 36 is located at a position shifted on the left side with respect to the center F of load of gravity of the particular end part 32B, the longer distance Z1 can be secured in comparison with a case where the tape cassette 5 contacts the pressing plate 32 at a position which is not shifted on the left side with respect to the center F of load of gravity of the pressing plate 32. Therefore, according to the printing device 1, the user's workload when the tape cassette 5 is attached to the printing device 1 can be suppressed. Further, in a state where the tape cassette 5 has been attached to the attachment part 20, the substrate 80 makes the surface contact with the pressing surface 32A, the pressing part 30 stably presses the substrate 80 as the entire pressing surface 32A presses the substrate 80.

Since the contacting part 36 is located at a position shifted on the left side with respect to the pair of exposed parts 34A, it becomes further possible that the printing device 1 can secure the longer distance Z1. Therefore, according to the printing device 1, the user's workload when the tape cassette 5 is attached to the printing device 1 can further be suppressed.

After contacting the contacting part 36, the tape cassette 5 further moves upward with contacting the particular end part 32B. In such a case, since the particular end part 32B inclines in the obliquely upper rear side, a frontward force acts on the pressing plate 32. Therefore, according to the printing device 1, the user's workload when the tape cassette 5 is attached to the printing device 1 can further be suppressed.

Since the regulating part 325 is located on a side opposite to the contacting part 36 with respect to the virtual plane C, when the tape cassette 5 contacts the contacting part 36, a rearward force acts on the regulating part 325. The contacting member 31B restricts a rearward movement of the regulating part 325 as the contacting member 31B contacts the regulating part 325 from the rear side. In this case, a principle of leverage functions such that the regulating 325 serves as a fulcrum, the contacting part 36 serves as a point of effort and the center F of load of gravity serves as a point of load. Therefore, according to the printing device 1, load when the tape cassette 5 is attached to the printing device 1 can further be suppressed.

Before the tape cassette 5 contacts the contacting part 36, insertion of the supporting part 49A and the guide hole 43 into the guiding members 201 and 202 is started. That is, after the front-rear and the right-left positions of the tape cassette 5 with respect to the attachment part 20 have been determined, the tape cassette 5 contacts the contacting part 36. Therefore, according to the printing device 1, it is ensured that the tape cassette 5 is caused to the contacting part 36 before the pressing plate 32 starts contacting the tape cassette 5, and it is ensured that the distance Z1 can be secured.

When the tape cassette 5 starts contacting the center F of load of gravity of the pressing plate 32, a first load on the user is generated for attaching the tape cassette 5 to the printing device 1. When engagement of the ribs 65A and 66A with the engaging parts 28A and 29B starts, a second load on the user is generated for attaching the tape cassette to the printing device 1. Since contact of the tape cassette 5 to the center F of load of gravity of the pressing plate 32 starts before engagement of the ribs 65A and 66A with the engaging parts 28A and 28B starts, the user's workload when the tape cassette 5 is attached to the printing device 1 can be suppressed in comparison with a case where the first load and the second load are generated for attaching the tape cassette 5 to the printing device 1.

In a state where the tape cassette 5 is attached to the attachment part 20, the pair of (i.e., two) main body side conductive electrodes 34 and the pair of (i.e., two) cassette side conductive electrodes 81 face and contact each other. In such a state, the pressing part 30 presses the substrate 80. Therefore, according to the printing device 1, it is ensured that the pair of main body side conductive electrodes 34 and the pair of cassette side conductive electrodes 81 contact each other.

According to the illustrative embodiment, there is a single urging member 33, which is arranged at the central position both in the right-left direction and in the up-down direction of the pair of exposed parts 34A. Therefore, the urging force of the urging member 33 acts evenly on the pair of (i.e., two) exposed parts 34A. Therefore, according to the printing device 1, it is ensured that the pair of main body side conductive electrodes 34 and the pair of cassette side conductive electrodes 81 contact each other.

The substrate 80 is provided to the cassette case 50. Inside the cassette case 50, a tape is accommodated. Accordingly, the printing device 1 can stored information regarding the tape in the IC chip 82, and effectively use the IC chip 82.

The lower wall 54 is formed such that a portion on the outer side with respect to the contacting surface 512 is recessed upwardly. Therefore, according to the printing device 1, it is possible to suppress a case where a portion different from the contacting surface 512 of the tape cassette 5 contacts the pressing plate 32 before the contacting surface 512 contacts the contacting part 36. Therefore, according to the printing device 1, it is ensured that the tape cassette 5 is caused to contact the contacting part 36, and it is ensured that the distance Z1 is secured.

The contacting surface 512 has an arc-like shape having a center of curvature on a side opposite to the contacting part 36 with respect to the contacting surface 512 in a state where the contacting surface 512 contacts the contacting part 36. Thus, the contacting surface 512 can contact the contacting part 36 at a point which is spaced farther from the center F of load of gravity in the right-left direction in comparison with a case where, for example, the contacting surface 512 linearly extends in the front-rear direction. Accordingly, it is suppressed that the contacting surface 512 contacts a portion different from the contacting part 36 of the pressing plate 32. Therefore, according to the printing device 1, it is ensured that the tape cassette 5 is caused to contact the contacting part 36, and it is ensured that the distance Z1 is secured.

When attached to the attachment part 20, the tape cassette 5 is supported by the protruding part 203. Since the protruding part 20 does not overlap the pressing part 30 in the up-down direction in a state where the tape cassette 5 is attached to the attachment part 20, it is ensured that the protruding part 203 can support the tape cassette 5.

On a rear part of the lower surface of the supporting part 31, an opening 312 is formed, and the second plate part 322 is exposed downward through the opening 312. With this configuration, even if the pressing plate 32 becomes unmovable from the second position by the urging force of the urging member 33 due to malfunction, the user can move the pressing plate 32 from the second position to the first position through the through the opening 312. Therefore, according to the printing device 1, even if such a malfunction occurs, the pressing plate 32 can easily be moved back to the first position.

According to the illustrative embodiment, the urging member 33 is a coil spring, and a shaft for guiding the elastic deformation of the urging member 33 is not inserted at the center of the urging member 33. Therefore, the urging member 33 can be deformed in the up-down direction and the right-left direction. Accordingly, when the tape cassette 5 is moving with being contacted with the pressing plate 32, the regulating part 325 tends to become the fulcrum. Therefore, according to the printing device 1, the user's load to attach the tape cassette 5 to the printing device 1 can be suppressed by making use of the principle of leverage mentioned above.

If the inclination angle θ is relatively large, a force acting frontward on the pressing plate 32 when the tape cassette 5 moves with contacting the particular end part 32B becomes larger and the user's load to attach the tape cassette 5 to the attachment part 20 is suppressed. However, when the inclination angle θ is relatively large, an area of the particular end part 32B becomes large, and the shape of the pressing plate 32 may be upsized. By setting the inclination angle θ to 45 degrees, it becomes possible to suppress upsizing of the shape of the pressing plate 32, while the user's load to attach the tape cassette 5 to the printing device 1 can be suppressed.

According to the illustrative embodiment, the ratio of the distance Z2 to the distance Z1 is 7/9. Therefore, a ratio of a distance the distance Z2 (i.e., the distance from the fulcrum (i.e., the regulating part 325) to the point of load (i.e., the center F of load of gravity)) to a distance from the fulcrum (i.e., the regulating part 325) to the point of effort (i.e., the contacting part 36) which is a sum of the distance Z1 and the distance Z2 is 7/16, which is smaller than ½. Therefore, according to the printing device 1, load in the up-down direction when the contacting surface 512 contacts the contacting part 36 by the principle of leverage can be reduced to ½ or less of the load in the right-left direction generated by the urging member 33.

When the tape is cut out by the cutting mechanism 15, cutting dust of the tape may be generated. According to the above-described configuration, since the pressing plate 32 is arranged at a position separated from the bottom wall 20A, even if the cutting dust of the tape moves along the bottom wall 20A, it is suppressed that the cutting dust is adhered onto the pair of main body side conductive electrodes 34. Therefore, according to the printing device 1, occurrence of contact failure between the pair of main body side conductive electrodes 34 and the pair of cassette side conductive electrodes 81 can be suppressed.

It is noted that the bottom wall 20A is an example of a bottom wall according to aspects of the present disclosures. The side wall 20B is an example of a side wall according to aspects of the present disclosures. The attachment part 20 is an example of an attachment part according to aspects of the present disclosures. The up-down direction of the printing device 1 is an example of a first direction according to aspects of the present disclosures. The tape cassette 5 is an example of a unit according to aspects of the present disclosures. Each of the guiding members 201 and 202 is an example of a guiding member according to aspects of the present disclosures. The pressing part 30 is an example of a pressing part according to aspects of the present disclosures. The pressing plate 32 is an example of a pressing plate according to aspects of the present disclosures. The urging member 33 is an example of an urging member according to aspects of the present disclosures. The rear direction of an example of a second direction according to aspects of the present disclosures. The pressing surface 32A is an example of a pressing surface according to aspects of the present disclosures. The main body side conductive electrode 34 is an example of a first conductive electrode according to aspects of the present disclosures. The left direction of the printer 1 is an example of a third direction according to aspects of the present disclosures. The particular end part 32B is an example of a particular end part according to aspects of the present disclosures. The contacting part 36 is an example of a contacting part according to aspects of the present disclosures. The regulating part 325 is an example of a regulating part according to aspects of the present disclosures. The contacting member 31B is an example of a contacting member according to aspects of the present disclosures. Each of the engaging parts 28A and 28B is an example of an engaging part according to aspects of the present disclosures. The cassette side conductive electrode 81 is an example of a second conductive electrode according to aspects of the present disclosures. The IC chip 82 is an example of a storing according to aspects of the present disclosures. The substrate 80 is an example of a substrate according to aspects of the present disclosures. The Y1 direction of the substrate 80 is an example of a fourth direction according to aspects of the present disclosures. The upper case 51 is an example of a first case according to aspects of the present disclosures. The lower case 52 is an example of a second case according to aspects of the present disclosures. The lower wall 54 is an example of a facing surface according to aspects of the present disclosures. The contacting surface 512 is an example of a contacting surface according to aspects of the present disclosures. The protruding part 20 is an example of a protruding part according to aspects of the present disclosures. The supporting part 31 is an example of a supporting part according to aspects of the present disclosures. The thermal head 22 is an example of a printing part according to aspects of the present disclosures. The cutting mechanism 15 is an example of a cutting mechanism according to aspects of the present disclosures.

It is noted that the above-described illustrative embodiment can be modified in various ways. For example, as shown in FIG. 14, the printing device 1 may employ a contacting part 361 instead of the contacting part 36. The contacting part 361 is located at a position shifted on the left side with respect to the center F of load of gravity and the pair of main body side conductive electrodes 34, and protrudes downward from the particular end part 32B. In this case, according to the printing device 1, it is suppressed that the tape cassette 5 contacts a portion different from the contacting part 361 of the pressing plate 32 before the contacting surface 512 contacts the contacting part 361. Therefore, according to the printing device 1, it is ensured that the tape cassette is caused to contact the contacting part 361. It is noted that the contacting surface 512 may be omitted. Alternatively, the shape of the contacting surface 512 may be a linearly extending shape.

The tape cassette 5 according to the illustrative embodiment is of the receptor type. However, according to aspects of the present disclosures, the cassette tape 5 could be of other types such as the thermal type, the laminate type, the tube type and the like. When the tape cassette 5 is of the thermal type, the ribbon roll 4A is omitted, and the supporting part 49A supports the first tape spool around which the thermos-sensitive tape is wound as the first tape (not shown). When the tape cassette 5 is of the laminate type, the supporting part 49A supports the first tape spool around which the both-side adhesive tape is wound as the first tape. The supporting part 49B supports the second tape spool 41 around which the film tape is wound as the second tape. The supporting part 49C supports the ribbon roll 4A as in a case where the tape cassette 5 is of the receptor type.

The pair of exposed parts 34A has a rectangular shape elongated in the up-down direction. The shape of the exposed parts 34A may be a rectangular shape elongated in the right-left direction, or other shapes such as a square shape, a circular shape or the like. According to the illustrative embodiment, the length in the longitudinal direction of the pair of exposed parts 34A is larger than the length, in the longitudinal direction, of the pair of cassette side conductive electrodes 81. The length, in the shorter side direction, of the pair of exposed parts 34A is smaller than the length, in the shorter side, of the pair of cassette side conductive electrodes 81. The distance of a clearance between the pair of (i.e., two) exposed parts 34A is larger than the distance of the clearance between the pair of (i.e., two) cassette side conductive electrodes 81.

The above configuration may be modified such that the length, in the longitudinal direction, of the pair of exposed parts 34A may be equal to or less than the length, in the longitudinal direction, of the pair of cassette side conductive electrodes 81. Further, the length, in the shorter side direction, of the pair of exposed parts 34A may be equal to or longer than the length, in the shorter side direction, of the pair of cassette side conductive electrodes 81. Further, the distance of the clearance between the pair of (i.e., two) exposed parts 34A may be equal to or smaller than the distance of the clearance between the pair of (i.e., two) cassette side conductive electrodes 81. It is noted that the number of the pair of the main body side conductive electrodes 34 need not be limited to one, but may be three or more, and the number of the pair of the cassette side conductive electrodes 81 need not be limited to one, but may be three or more.

According to the illustrative embodiment, the CPU of the printing device 1 is configured to receive, from the IC chip 82, a signal carrying information in accordance with a certain modulation method. It is noted that the modulation method need not be limited to the above-described one, but the CPU of the printing device 1 may receive a signal from the IC chip 82 carrying information in accordance with another method. For example, the CPU of the printing device 1 may be configured to receive a differential signal from the IC chip 82.

According to the illustrative embodiment, the first surface 80A is arranged on the right side with respect to the right wall 55. Such a configuration may be modified such that the first surface 80A may be arranged at the same position, in the right-left direction, as the right wall, or arranged on the left side with respect to the right wall 55. In such a configuration, it becomes possible to suppress a case where a portion of the substrate 80 protruding rightward from the right wall 55 is caught by the right wall 55 when the tape cassette 5 is in use and the substrate 80 comes off from the arrangement part 70.

According to the illustrative embodiment, the urging member 33 is a single coil spring. Such a configuration could be modified such that the urging member 33 may include two or more coil springs, or other kinds of springs (e.g., a disc spring, a plate spring and the like). Alternatively, the urging member 33 may be elastic members such as robber, sponge and the like. According to the illustrative embodiment, a shaft for guiding an elastic deformation of the urging member 33 is not inserted at the center of the urging member 33. The configuration may be modified such that a shaft for guiding the elastic deformation of the urging member 33 is provided at the center of the urging member 33. According to such a modification, movement of the pressing plate 32 between the first position and the second position is stabilized.

On the lower surface of the supporting part 31, the opening 312 is formed. The configuration may be modified such that no opening is formed on the lower surface of the supporting part 31. In such a case, entering of foreign matters through the lower surface of the supporting part 31 can be suppressed. Regarding the attachment part 20, only one of the guiding members 201 and 202 may be provided. Alternatively, the attachment part 20 may be provided with three or more guiding members.

The distance Z1 may be larger than or smaller than 9 mm. The distance Z2 may be larger than or smaller than 7 mm. The ratio of the distance Z2 to the distance Z1 may be larger than or smaller than 7/9. It is preferable that the ratio of the distance Z2 to the distance Z1 is within a range in which the ratio is not significantly different from 7/9. The inclination angle θ may be larger than or smaller than 45 degrees. It is preferable that the inclination angle θ is within a range in which the inclination angle θ is not significantly different from 45 degrees. When the inclination angle θ is 45 degrees or larger, it is preferable that the distance, in the right-left direction, between the first surface 80A and the right wall 55 in the right-left direction is smaller than the distance, in the up-down direction, between the lower end of the substrate 80 and the lower end of the contacting surface 512. According to such a configuration, it is ensured that the contacting surface 512 contacts the contacting part 36.

What is claimed is:

1. A unit attaching structure configured such that a unit is detachable and attachable with respect to the unit attaching structure, the unit attaching structure comprising:

an attachment part having a bottom wall and a side wall intersecting with the bottom wall, the attachment part being configured such that the unit is detachable and attachable with respect to the attachment part along a first direction perpendicular to the bottom wall;

a guiding member extending in the first direction, the guiding member being configured to engage with the unit to guide the unit to the attachment part when the unit is to be attached to the attachment part; and a pressing part provided to the side wall and configured to press the unit attached to the attachment part, wherein the pressing part comprises:

a pressing plate having a rectangular shape viewed from a direction perpendicular to the side wall, the pressing plate being movable between a first position and a second position, the pressing plate being configured to protrude from the side wall when located at the first position, the pressing plate being configured to protrude from the side wall by a less amount when located at the second position than when located at the first position, the pressing plate being configured to contact the unit when the unit is attached to the attachment part; and an urging member configured to urge the pressing plate from the second position toward the first position, wherein the pressing plate has a pressing surface directed to a second direction from the second position to the first position, a plurality of first conductive electrodes being arranged on the pressing surface in a third direction perpendicular to both the first direction and the second direction, wherein, when the unit starts contacting the pressing plate, the unit is configured to contact a contacting part, the contacting part being a part of a particular end part of the pressing plate on a side opposite to the bottom wall and shifted in the third direction with respect to a position of center of load of gravity by urging of the urging member to the pressing plate, wherein the unit is configured to move with contacting the pressing surface and to be attached to the attachment part after contacting the contacting part, and wherein a contacting range, in the third direction, of the unit and the contacting part is smaller than a contacting range, in the third direction, of the unit attached to the attachment part and the pressing plate.

2. The unit attaching structure according to claim 1, wherein the contacting part is located at a position shifted in the third direction with respect to the plurality of first conductive electrodes.

3. The unit attaching structure according to claim 1, wherein the particular end part extends in a direction inclined, with respect to the second direction, toward a one-way direction of the first direction along which the unit is attached to the attachment part.

4. The unit attaching structure according to claim 1, further comprising a contacting member configured to contact a regulating part in a direction opposite to the second direction in a state where the pressing plate is located at the first position, wherein the regulating part is a part of the pressing plate, the regulating part being arranged on a side opposite to the contacting part with respect to a virtual plane, and wherein the virtual plane is a plane passing the position of the center of load of gravity and perpendicularly intersecting a line connecting the contacting part and the position of the center of load of gravity.

5. The unit attaching structure according to claim 1, wherein a distance, in the first direction, between the unit and the bottom wall when engagement of the unit with respect to the guiding member starts is larger than a distance, in the first direction, between the unit and the bottom wall when the unit contacts the contacting part.

6. The unit attaching structure according to claim 1, further comprising an engaging part configured to engage with the unit attached to the attachment part to restrict movement of the unit in the first direction, wherein a distance, in the first direction, between the unit and the bottom wall when the unit starts contacting the center of load of gravity of the pressing plate is larger than a distance, in the first direction, between the unit and the bottom wall when engagement of the engaging part with the unit starts.

7. The unit attaching structure according to claim 1, the unit having a first surface exposed to outside and a second surface opposite to the first surface, a plurality of second conductive electrodes being provided to the first surface, a substrate having a storage electrically connected with the plurality of second conductive electrodes being provided to the second surface, wherein the plurality of second conductive electrodes are aligned in a fourth direction which is parallel to the substrate, and wherein, in a state where the unit is attached to the attachment part, the third direction and the fourth direction coincide with each other and the plurality of first conductive electrodes and the plurality of second conductive electrodes respectively face and contact each other.

8. The unit attaching structure according to claim 1, wherein the urging member is a single member and arranged at a center of the plurality of first conductive electrodes.

9. The unit attaching structure according to claim 1, wherein the unit is a tape cassette having a box-like cassette case and a tape accommodated in the cassette case.

10. The unit attaching structure according to claim 9, wherein the cassette case includes a first casing and a second casing coupled to the first casing, wherein, in a state where the tape cassette is attached to the attachment part, the first casing is arranged on a side opposite to the bottom wall with respect to the second casing, the second casing facing the bottom wall in the first direction, and wherein the cassette case has a contacting surface extending, toward the bottom surface, from a facing surface of the second casing facing the bottom wall, the contacting surface being configured to contact the contacting part when the tape cassette starts contacting the pressing plate.

11. The unit attaching structure according to claim 10, wherein the contacting surface has an arc-like shape having a center of curvature on a side opposite to the contacting part with respect to the contacting surface in a state where the contacting surface contacts the contacting part.

12. The unit attaching structure according to claim 9, wherein the contacting part protrudes from the particular end part.

13. The unit attaching structure according to claim 10, further comprising a protruding part protruding from the bottom wall, the protruding part does not overlap the pressing part in the first direction in a state where the pressing plate is located at the second position.

14. The unit attaching structure according to claim 1, wherein the pressing part has a supporting part configured to movably support the pressing plate so as to be movable between the first position and the second position, and wherein the supporting part has an opening toward opposite to the bottom wall.

15. The unit attaching structure according to claim 1, wherein the urging member comprises a coil spring.

16. The unit attaching structure according to claim 3, wherein an inclination angle of the particular end part with respect to the second direction is substantially 45 degrees.

17. The unit attaching structure according to claim 4, wherein a ratio of a distance between the center of load of gravity and the regulating part to a distance between the center of load of gravity and the contacting part is substantially 7/9.

18. A printing device, the printing device comprising a unit attaching structure, the unit attaching structure is configured such that a unit is detachable and attachable with respect to the unit attaching structure, the unit attaching structure comprising:

an attachment part having a bottom wall and a side wall intersecting with the bottom wall, the attachment part being configured such that the unit is detachable and attachable with respect to the attachment part along a first direction perpendicular to the bottom wall;

a guiding member extending in the first direction, the guiding member being configured to engage with the unit to guide the unit to the attachment part when the unit is to be attached to the attachment part; and a pressing part provided to the side wall and configured to press the unit attached to the attachment part, wherein the pressing part comprises:

a pressing plate having a rectangular shape viewed from a direction perpendicular to the side wall, the pressing plate being movable between a first position and a second position, the pressing plate being configured to protrude from the side wall when located at the first position, the pressing plate being configured to protrude from the side wall by a less amount when located at the second position than when located at the first position, the pressing plate being configured to contact the unit when the unit is attached to the attachment part; and an urging member configured to urge the pressing plate from the second position toward the first position, wherein the pressing plate has a pressing surface directed to a second direction from the second position to the first position, a plurality of first conductive electrodes being arranged on the pressing surface in a third direction perpendicular to both the first direction and the second direction, wherein, when the unit starts contacting the pressing plate, the unit is configured to contact a contacting part, the contacting part being a part of a particular end part of the pressing plate on a side opposite to the bottom wall and shifted in the third direction with respect to a position of center of load of gravity by urging of the urging member to the pressing plate, wherein the unit is configured to move with contacting the pressing surface and to be attached to the attachment part after contacting the contacting part, and wherein a contacting range, in the third direction, of the unit and the contacting part is smaller than a contacting range, in the third direction, of the unit attached to the attachment part and the pressing plate, the unit containing a printing medium, the printing device further comprising:

a printing part configured to perform printing on the printing medium; and a cutting mechanism configured to cut out the printing medium on which printing is performed by the printing device, wherein the pressing plate is arranged spaced from the bottom wall.

19. A unit attaching structure, comprising:

an attachment part having a bottom wall and a side wall intersecting with the bottom wall;

a unit configured to be detachable and attachable with respect to the attachment part along a first direction perpendicular to the bottom wall;

a guiding member extending in the first direction, the guiding member being configured to engage with the unit to guide the unit to the attachment part when the unit is to be attached to the attachment part; and a pressing part provided to the side wall and configured to press the unit attached to the attachment part, wherein the pressing part comprises:

a pressing plate having a rectangular shape viewed from a direction perpendicular to the side wall, the pressing plate being movable between a first position and a second position, the pressing plate being configured to protrude from the side wall when located at the first position, the pressing plate being configured to protrude from the side wall by a less amount when located at the second position than when located at the first position, the pressing plate being configured to contact the unit when the unit is attached to the attachment part; and an urging member configured to urge the pressing plate from the second position toward the first position, wherein the pressing plate has a pressing surface directed to a second direction from the second position to the first position, a plurality of first conductive electrodes being arranged on the pressing surface in a third direction perpendicular to both the first direction and the second direction, wherein, when the unit starts contacting the pressing plate, the unit is configured to contact a contacting part, the contacting part being a part of a particular end part of the pressing plate on a side opposite to the bottom wall and shifted in the third direction with respect to a position of center of load of gravity by urging of the urging member to the pressing plate, wherein the unit is configured to move with contacting the pressing surface and to be attached to the attachment part after contacting the contacting part, and wherein a contacting range, in the third direction, of the unit and the contacting part is smaller than a contacting range, in the third direction, of the unit attached to the attachment part and the pressing plate.

* * * * *